US006923237B2

(12) United States Patent
Workman et al.

(10) Patent No.: US 6,923,237 B2
(45) Date of Patent: Aug. 2, 2005

(54) MECHANISM FOR BOTTOM UP SHADES

(76) Inventors: Brian G. Workman, 20-D S. Nome St., Aurora, CO (US) 90012; Paul T. Rodgers, 825 Dahlia St., #506, Denver, CO (US) 80220

( * ) Notice: Subject to any disclaimer, the term of this patent is extended or adjusted under 35 U.S.C. 154(b) by 0 days.

(21) Appl. No.: 10/242,527

(22) Filed: Sep. 12, 2002

(65) Prior Publication Data

US 2003/0070767 A1 Apr. 17, 2003

Related U.S. Application Data

(63) Continuation-in-part of application No. 09/497,557, filed on Feb. 3, 2000, now Pat. No. 6,478,071.

(60) Provisional application No. 60/171,284, filed on Dec. 21, 1999, provisional application No. 60/158,857, filed on Oct. 12, 1999, and provisional application No. 60/118,889, filed on Feb. 5, 1999.

(51) Int. Cl.[7] ..... E06B 9/30; E06B 3/48

(52) U.S. Cl. ..... 160/84.06; 160/169

(58) Field of Search ..... 160/84.04, 84.05, 160/84.06, 84.01, 84.07, 169, 167 R

(56) References Cited

U.S. PATENT DOCUMENTS

| | | | | | |
|---|---|---|---|---|---|
| 3,192,991 | A | * | 7/1965 | Anderle | 160/167 R |
| 4,518,025 | A | | 5/1985 | Judkins | |
| 4,673,018 | A | * | 6/1987 | Judkins | 160/84.06 |
| 4,813,468 | A | * | 3/1989 | Fraser | 160/84.03 |
| 4,934,436 | A | | 6/1990 | Schnebly | |
| 5,002,112 | A | | 3/1991 | Schnebly et al. | |
| 5,092,383 | A | | 3/1992 | Niemeijer et al. | |
| 5,197,526 | A | | 3/1993 | Schon | |
| 5,207,257 | A | | 5/1993 | Rupel et al. | |
| 5,443,108 | A | * | 8/1995 | LeVert et al. | 160/167 R |
| 5,791,390 | A | * | 8/1998 | Watanabe | 160/84.03 |
| 5,860,464 | A | * | 1/1999 | Schon | 160/84.06 |
| 6,164,362 | A | * | 12/2000 | Yang | 160/84.04 |
| 6,478,071 | B1 | * | 11/2002 | Workman et al. | 160/84.04 |
| 6,530,413 | B2 | * | 3/2003 | Hwang | 160/84.03 |

FOREIGN PATENT DOCUMENTS

| | | |
|---|---|---|
| DE | 4037264 A | 5/1992 |
| EP | 0 058 459 | 2/1981 |
| EP | 534261 A2 | 9/1992 |
| JP | 4-269919 A | 9/1992 |
| WO | WO 92/15765 | 9/1992 |

* cited by examiner

*Primary Examiner*—Blair M. Johnson
(74) *Attorney, Agent, or Firm*—Dorr, Carson, Sloan, Birney & Kramer, P.C.

(57) ABSTRACT

Improved apparatus for bottom up shades to minimize gaps between the shade material and the lintel or between the shade material and the side of the window. In one apparatus a support rod is attached to a pull cord which is attached to the headrail which causes a rotation of the head rail and results in moving the top of the shade to the lintel. In another apparatus a centering cord moves the shade to the side and a side support rod symmetrically hangs the shade, thus, eliminating the gap on the side. A further improvement of a valance on the bottom acts to hide the mechanism and to act as a cradle for the shade material and headrail when the shade is in the down position.

16 Claims, 33 Drawing Sheets

MECHANISM FOR BOTTOM UP SHADES

RELATED APPLICATIONS

This application is a Continuation-In-Part of U.S. application Ser. No. 09/497,557, filed Feb. 3, 2000, now U.S. Pat. No. 6,478,071, issued Nov. 12, 2002 and claims the benefit of U.S. Provisional patent application Ser. No. 60/118,889, filed Feb. 5, 1999, U.S. Provisional patent application Ser. No. 60/158,857, filed Oct. 12, 1999 and U.S. Provisional patent application Ser. No. 60/171,284, filed Dec. 21, 1999.

BACKGROUND OF THE INVENTION

1. Field of the Invention

The present invention relates to an improvement for bottom up window shades or blinds for use in residential or commercial applications as described herein. The shade mechanisms disclosed herein are ideally disposed to applications involving nonrectangular window shapes such as triangular frames, arches, arcuate sections, and other partial or full elliptical forms and an improved method of eliminating small gaps between the shade and lintel or between the shade and side frame. Additionally the within shade invention improves the appearance of pull up shades by including a valance that hides the shade material and mechanism and also holds the shade material when it is down.

2. Discussion of the Background

The improvements set out herein addresses and help remove gaps that can occur between the top or sides of pull up shades as described herein and in U.S. Pat. No. 6.478.071.

Due to gravity the weight of the shade material can cause the top of the shade, which meets the lintel, or the sides of the shade to be pulled down, leaving a gap between the top and the lintel surface or between the side of the shade and the side frame. This can occur in arched, square, triangular or trapezoid openings. The unique design of the headrail and support rods is used to avoid these problems.

On bottom up type shades a further improvement to the shade is the use of a valance as part of the shade, which hides and protects the bottom draw cord mechanism as well as the shade material when it is down. Further, it acts as a holder for the shade and headrail mechanism when it is down, and simplifies installation and the workings mechanism.

DESCRIPTION OF RELATED ART

Schnebly (U.S. Pat. No. 4,934,436) (Schnebly I) discloses shade systems for covering arched windows. In one embodiment, pleated or honeycomb fabric is trimmed into an arched configuration and is fixedly mounted to the sill. It is raised to cover the window by means of a continuous cord under constant tension attached at a fixed point to the top pleat of the shade material. A problem with this design arises from the stress placed upon a single point of the shade material engaged for raising and lowering its entire weight and structure. Similarly, the outer edges of the top surface of the shade are not supported. This requires a limitation of available shade materials to those with sufficient horizontal stiffness or structure, such as honeycomb, to prevent the sides of the shade from sagging. In practice, even the more rigid materials droop over longer spans. Additionally, when lowered, the pleats, if more rigid, tend to splay out in a fan shape rather than lay flat.

Schnebly I also discloses a system for covering arcuate windows via two hinged edge rails. Each pleated edge of pleated or honeycomb shade material is attached to each edge rail respectively, in essence forming a fan with the hinge providing ability to adjust the splay of the fan. In one embodiment the fan must be manually placed within or removed from the window frame which limits its usefulness, especially for windows placed high on a wall in a room with a vaulted ceiling. Another embodiment employs a drawstring, but its application is limited to windows of acute angles as gravity is required to collapse the fan and return the shade to a closed position. With both designs there are the additional limitations of bunching of shade material and a hole in the coverage of the shade material as it bends out around the hinge. This hole is also aesthetically displeasing and requires some additional shade or ornamentation to disguise it.

Schnebly et al. (U.S. Pat. No. 5,002,112) (Schnebly II) provides additional embodiments for covering arched and arcuate windows. These consist of fixed fans of pleated or honeycomb material supported on fixed arcuate frames with finger-like extensions for engaging the pleats or honeycombs to supply the necessary arcuate splay and some minimal vertical support. These systems are static and must be manually placed within or removed from the window frame, thereby severely limiting their usefulness. As with Schnebly I, applications of these systems are limited to fairly rigid, pleated or honeycomb shade materials as other materials would not have the stiffness required to support their own weight in such fan-like configurations.

Judkins (U.S. Pat. No. 4,518,025) discloses a system for clamping the top edges of irregular shaped shades to the upper rail mounted in the lintel. Pitched and arched shades are particularly shown. This system does not, however, allow the shades to be entirely raised. Retraction is limited to portions covering rectangular areas only. When an irregular section is reached, the shade can be opened no further because either the bottom rail encounters the lintel on one side or it is unable to travel through the narrowing frame of an arched section.

Niemeijer et al. (U.S. Pat. No. 5,092,383) discloses shade mechanisms for covering rectangular windows with pitched or arcuate lintels. The invention uses pleated or honeycomb shade material as well and is concentrated on an intricate weaving system of drawstrings through the shade material and a guide system to continue to evenly raise the shade through the pitched and arcuate sections without binding once the rectangular window section is passed. A middle rail is used at the threshold between the rectangular and pitched or arcuate sections. The lower shade material stacks against the underside of the middle rail which is hinged on one end to the lower end of the upper rail along the lintel. The middle rail in a pitched embodiment travels to finally rest against the upper rail. Niemeijer also considers using flexible middle and bottom rails, e.g., made out of flexible plastic, to conform to arcuate lintels when the shades are drawn fully open. Problems with this invention are similar to those previously described: the shade material in the pitched or arcuate portion is not horizontal, but bunched and fanned; as the middle rail travels through the angle on its hinge, the shade material is subjected to tension, stress, and possible tearing due to the difference in width between the rectangular section and upper rail; and the shade material available is limited to rigid pleated or honeycomb structures. In the arcuate configuration utilizing flexible rails, the shade material is subject to even more tension and stress.

Wolf et al. (DE 4037264A1) similarly discloses a hinged middle rail system for covering a pitched top portion of an otherwise rectangular window. The invention is substantially similar to that of Niemeijer et al. and therefore shares its problems and limitations.

Schön (U.S. Pat. No. 5,197,526) (Schön I) discusses shades for shading triangular, trapezoidal, polygonal, or semicircular windows using pleated or gatherable shade material. In all of the various embodiments shown and discussed, the basic principal revealed is the use of guide cords running through the lateral edges of the shade material to keep it horizontally stretched across the window frame. Additional draw cords are used, spaced appropriately along the horizontal width, to raise or lower the shade. This solution is both practically limited and aesthetically unpleasing. The Schön I invention creates severe bunching of the shade material at the application points of the draw cords. Also inherent in the design, the lateral edges of the shade material drag behind and lower along the guide cords. The shades of this disclosure can never be fully and uniformly raised and they create great tension and stress on the shade material, potentially ripping or tearing it.

Schön et al. (EP 0058459) (Schön II) discloses a shade for use in a frame with a non-horizontal lintel. The top of the shade is trimmed diagonally and appears to be secured to the upper rail by a cord woven along the diagonal through openings in the edge of the shade material. Schön II states that this allows for freedom of movement along the top edge as the bottom rail is tilted while bringing the longer side of the shade against the upper rail. This cord system does not, however, prevent the bunching of shade material on one side nor reduce the stress on the shade material between the dual drawstrings running lengthwise through the material to the bottom rail. When the bottom rail begins to tilt, the formerly uniform distance between the draw cords progressively widens creating tension, stress, and potential tearing of the shade material in between.

Steiger (PCT/EP 92/00382) discloses a shade for triangular window segments composed of a shorter upper rail to which the top edge of the shade material is attached. The upper rail is raised and lowered via a cord system raising and lowering the shade similar to a boat sail. Guide cords threaded through openings on the lateral edges of the shade material keep the shade in the frame, guide cords along angled sides being tensioned to provide or remove slack as needed. Apparent limitations with this design include the inability to provide coverage at the apex of the window and the necessity for a separate shade or hinged middle rail as in Niemeijer to cover the lower rectangular portion of the window.

Scharfenberg (EP 0534261-A2) discloses a window shade for trapezoidal windows similarly incorporating a shorter top rail and tensioned lateral edge guide cords, as well as a tensioned cord along which the top rail manually travels to raise and lower the shade. Applications for this shade are limited to trapezoidal shapes; it is unable to operate in arched, triangular, or other pitched lintel situations.

Finally, Rupel et al. (U.S. Pat. No. 5,207,257) and Yamakawa (JP 404269919) each disclose a shade for a rectangular window frame using pleated shade material which by means of a separate drawstring collapses a hinged bottom rail upwards to create a decorative fan-shaped shade.

SUMMARY OF THE INVENTION

As disclosed herein and in U.S. Pat. No. 6.478.071, the arched lintel shade can give a pleasing appearance. Specifically, FIG. 17 illustrates a single headrail for the top pull cord that is in a track along the top lintel surface.

This has certain drawbacks, including the use of a cord track in or attached to the lintel, which is an added bit of hardware that may need to be hidden and require complex installation requirements. Additionally, the headrail, as shown in FIG. 17, tends to leave a gap at the top where the shade does not quite meet the lintel.

FIG. 24 illustrates the use of a top valance to hide the hardware and to hide any gaps that may be left when the shade is raised. This is a suitable solution in some, but not all circumstances.

The present invention, as shown in FIG. 28, addresses these drawbacks and specifically instead of a top cord and track uses a cord on the bottom of the window opening, in a location where the shade anchor is already positioned and thus, there is no need to have extra hardware or external hardware. Also the gap is diminished by the design of the headrail. This eliminates the need for a top valance. This apparatus can also be used to minimize gaps in square bottom up shades.

The within improvement for an arched or square lintel in one embodiment is a support and mechanical system for raising and lowering a shade that is bottom mounted, with the ability to closely conform or snug the top of the shade to the lintel and thereby reduce any gaps therebetween.

The mechanism makes use of a pull cord that is activated and located at the bottom of the shade and operational with or without a valance. It goes from the bottom side of the bottom middle of the shade, and makes a 90° turn. Thereafter it goes to the apex of the arched window opening or the square lintel. At the apex the cord is directed over an anchor or part of the top frame and turns 180° and returns parallel to the immediately proceeding run to the top It is attached to the top of the headrail which is located on the posterior side of the shade. The headrail has a first support rod cord that attaches near the bottom of the headrail on the posterior side of the headrail. The other end of the first support rod cord is attached to the first support rod anchor, or attachment and support lifting device located in the shade material near the top of the shade but below the headrail when the shade is extended and closed and the cord is taut in the closed position.

A second support rod is attached to the first support rod and is connected to a second support rod anchor or a support and lifting device in the shade, lower in the shade then the first support rod. When the pull cord is pulled to raise the shade and lifts the top anterior side of the headrail, the headrail is elevated and by a top rod in the top edge of the shade which is attached to the headrail causes the shade to be pushed upward toward the lintel. As the shade extends higher it eventually stretches out the entire shade material to cover the opening.

With the first support rod cord attached to the headrail the first support rod starts to move when the support rod cord for that anchor point becomes taut. This operates to take some of the vertical load from the shade material, thus distributing some of the weight from the shade material above and the shade attachment to the headrail. Similarly the second support rod cord is taut when the shade is pulled up further.

Additionally, by the placement of the first support rod cord, this weight will cause the headrail to rotate with the anterior top portion of the headrail rotating upward relative to the posterior side of the headrail. That rotation will, in turn, push the top rod and shade material up and snug and in close conformation with the apex of the lintel or to lintel shape.

On the trapezoid shape as illustrated in FIG. 10*d,* the problem is the headrail, by gravity being pulled away from the apex of the window opening, leaving a gap between the side of the window and that side of the shade. This is addressed herein by a centering cord.

However, even with the gravity effect being overcome by the centering cord and the headrail being pulled up to the apex, another gap can occur further down the side when the long side of the window covering is very great or long or the apex angle is very acute. The proportion of the shade (which is the triangle formed from the apex to a level equal to the lower end of the lintel), usually is centered in the opening by way of the centering cord.

Along the one side corresponding to the high side of the opening, there can occur a gap along the side below the upper portion. This gap occurs by way of the long length of shade material held by the headrail at the apex on one side but the other side is held at a lower point by the low end of the shade headrail.

The long side tends to be pulled away and the shade material distorted. FIG. 30 illustrates the improved manner to overcome this affect on long or acute angled shades. A support rod or anchor is placed in the shade material at approximately the level of the lower end of the headrail when the shade is fully extended. The level of this side support rod may be located other then at this location so long as it is not to near the top or bottom of the shade. This shade support rod or anchor hereby directly holds the lower portion of the long side of the shade at approximately the same level as the headrail on the lower end resulting in the long shade hanging symmetrically on both sides of the rectangular portion below the triangle top. The centering cord, in addition to being attached to the headrail, is attached to the side support rod. When the centering cord is pulled to the side and elevates the high side of the headrail and shade and centers it in the opening, it also makes the side support cord taut to the side support rod and thus evenly suspends the lower portion of the shade. This then reduces any gap on the side of the long shade.

A further improvement over the invention disclosed herein and in U.S. Pat. No. 6,478,071 is illustrated in FIG. 31 and is the addition of a valance to the shade for bottom up shades. The valance is part of the shade, with material and color to match or to compliment the shade material and installation.

The valance is part of the structure of the bottom of the shade assembly and functions as a holder or cradle for the shade material when the shade is lowered. Thus, the shade in its collapsed condition is supported on the exterior side by the valance and by the window or another valance on the window side. The height of the valance can be any height, but normally it will be tall enough to keep the stack of shade material contained. The valance also operates to hide the lowered shade material, along with the headrail, from view when the shade is lowered. This results in a clean uncluttered appearance.

Further, for those bottom up shades with the draw works in the bottom of the shade, the draw cord can be routed along the bottom of the valence structure through cord guides and thus, out of harms way and out of view.

Finally, by including the valance, the entire subassembly of the shade, the draw cords, the cord guides, support rods, valance, and headrail can be preassembled for ease of installation in a window opening. The draw cord and any guide cords can be ready for attachment to the lintel. Also, any top adjustments can be done in the field, based on the bottom portion and subassembly being in a ready to use condition.

DETAILED DESCRIPTION OF THE INVENTION

Figure 1A:
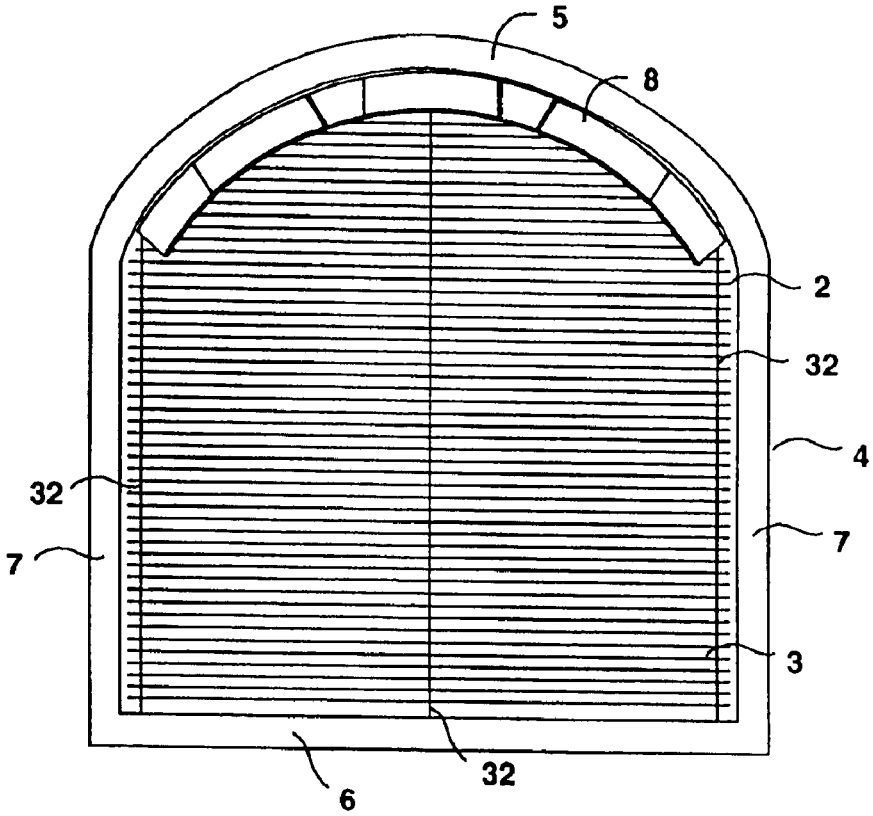
FIG. 1*a* is a front view of an arched embodiment of the present invention with the shade fully closed.
Figure 1B:
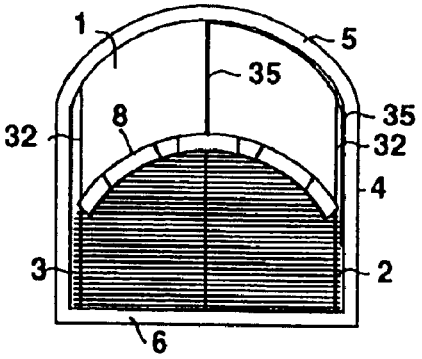
FIG. 1*b* is a front view of a arched embodiment of the present invention with the shade partially closed.
Figure 1C:
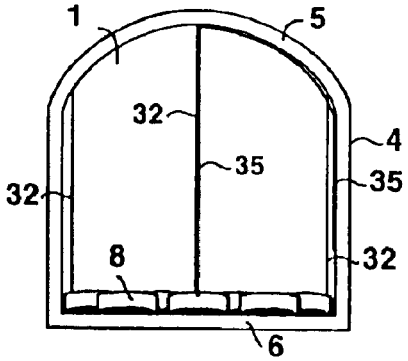
FIG. 1*c* is a front view of an arched embodiment of the present invention with the shade fully opens.
Figure 2:
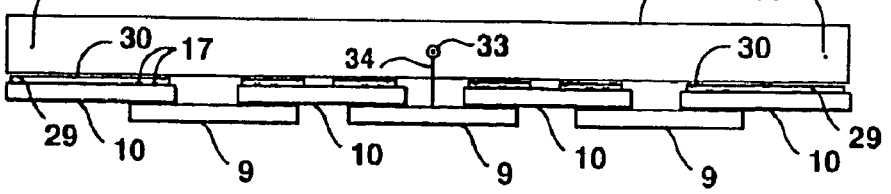
FIG. 2 is a top view of an arched embodiment of the present inventions.

An arched embodiment of the present invention is displayed in FIG. 1*a* in a fully closed position. FIGS. 1*b* and 1*c* show the window shade 2 in partially open and fully open positions respectively. The sliding headrail 8 conforms to the shape of the lintel 5, supporting the shade material 3 to cover the window 1. The sliding headrail 8 is constructed by overlapping and underlying anterior headrail sections 9 and posterior headrail sections 10 respectively. In FIG. 2 this assembly can be seen more clearly from a top view. The headrail sections 9 and 10 can be constructed of most any suitably dense, rigid material such as wood, plastic, metal, resin, composite or other similar material.

Figure 3:
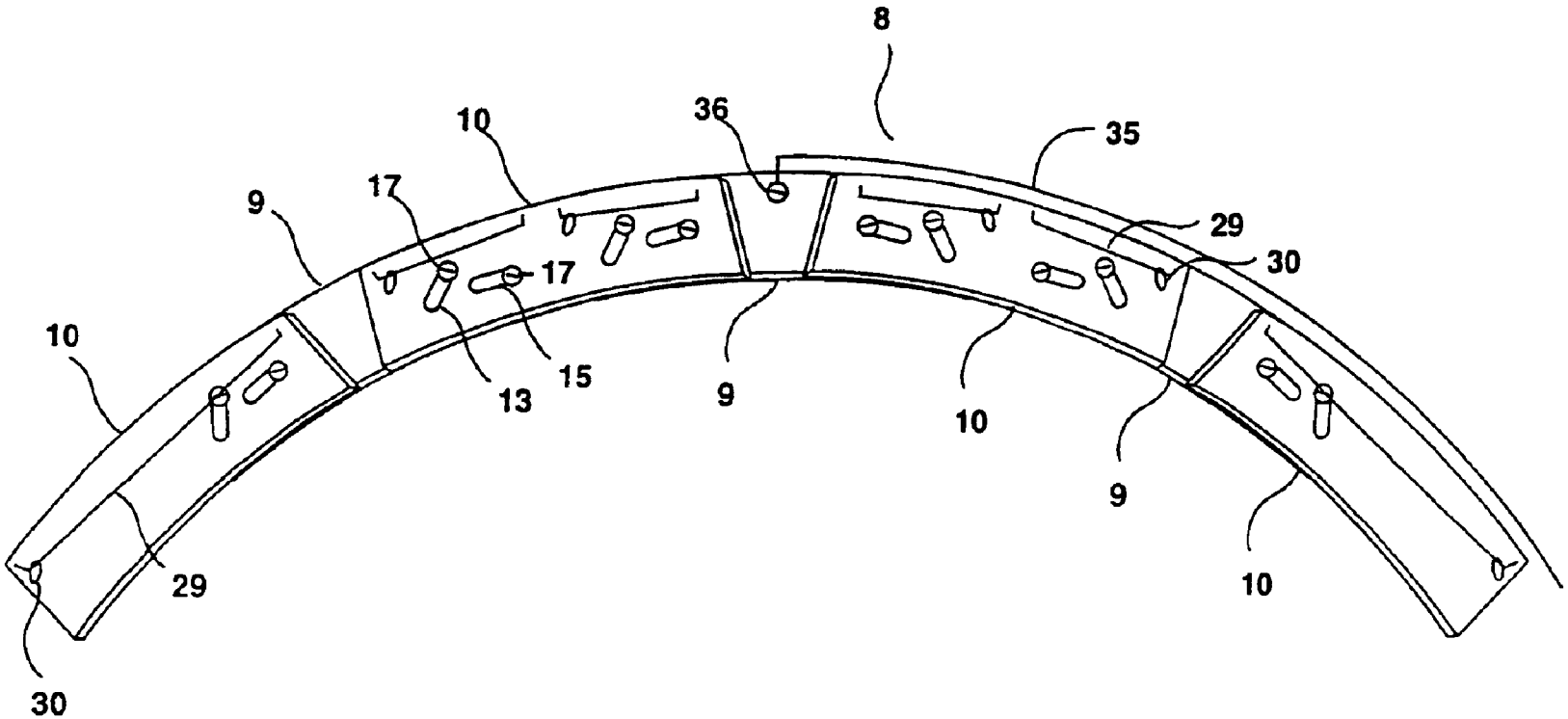
FIG. 3 is a rear view of an arched embodiment of the sliding headrail mechanism.
Figure 5:
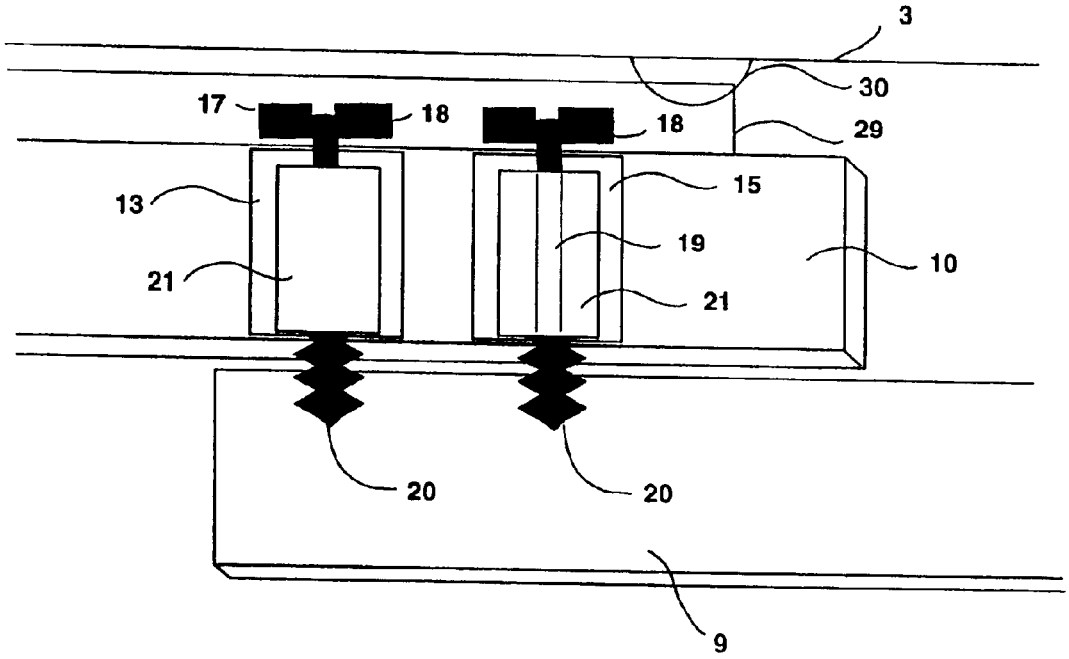
FIG. 5 is a cross section of the slots and pins in the joining the sliding headrail sections.

The anterior headrail sections 9 are joined to the posterior headrail sections 10 by means of slot pins 17 as seen in FIGS. 3 and 5. Slot pins 17 can be screws, nails, rivets or other similar fastening devices to allow for the necessary movement as described. Slot pins 17 are inserted through curvature slots 13 and anti-rotation slots 15, respectively, on the posterior headrail sections 10. The slot pins 17 are fixedly attached to the back side of the anterior headrail sections 9, via screw threads 20 in the present embodiment. The heads 18 of the slot pins 17 have a greater diameter than the width of the curvature slots 13 and anti-rotation slots 15, thereby preventing separation of the anterior headrail sections 9 from the posterior headrail sections 10.

Figure 4A:
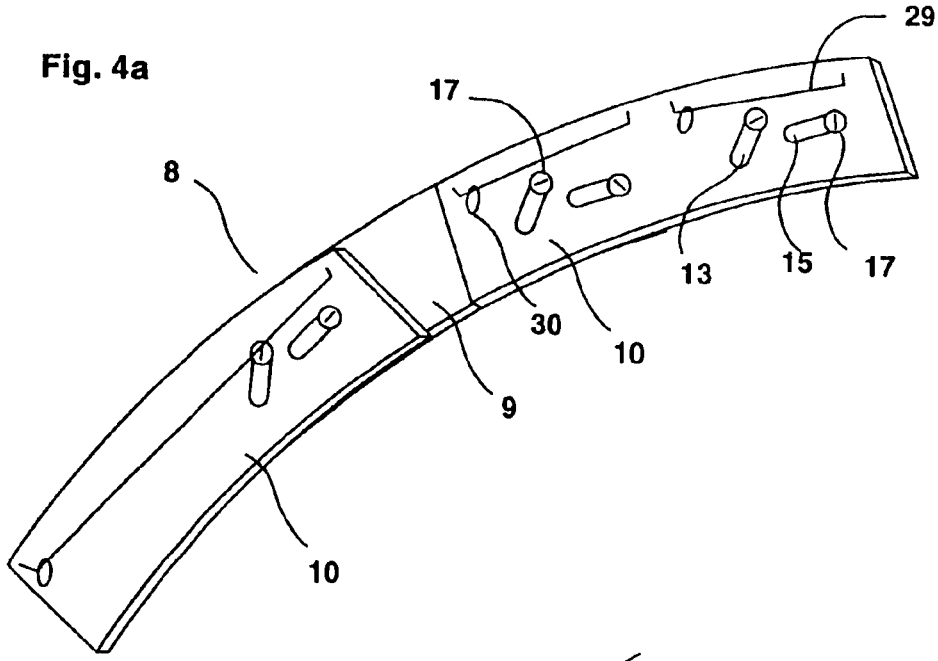
FIG. 4*a* is a partial view of headrail slots on the rear of the sliding headrail.
Figure 4B:
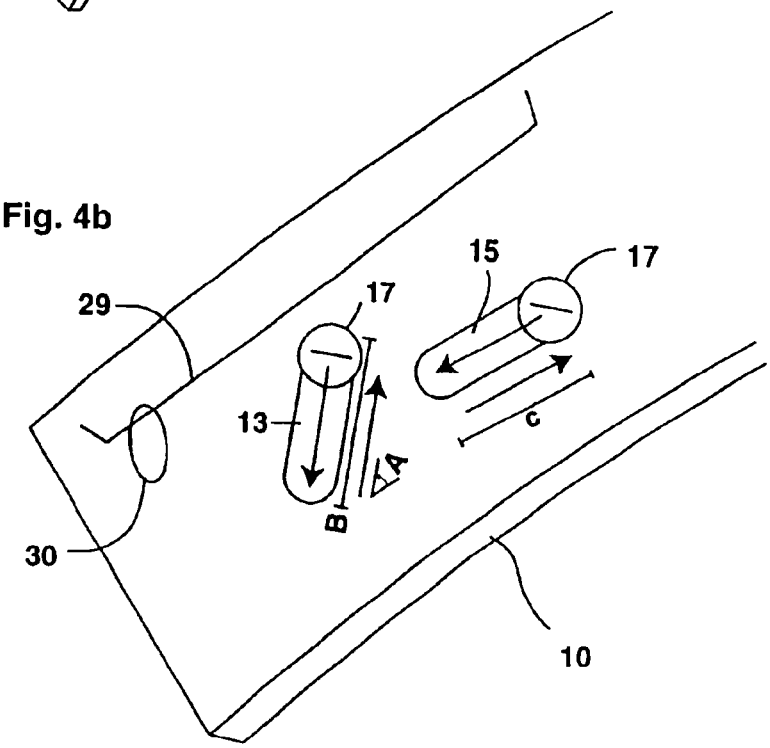
FIG. 4*b* is a detailed partial view of headrail slots on the rear of the sliding headrail.

As depicted in the drawings, particularly in FIGS. 3, 4*a*, and 4*b*, the curvature slots 13 and the anti-rotation slots 15 are linear apertures in the posterior headrail sections 10. These slots could also merely be recessed with lateral channels to accept the head 18 of a slot pin 17, a plate with a slotted aperture covering the recess to restrain the head 18 of a slot pin 17, or other means of creating a channel for the head 18 of a slot pin 17 to travel. Other appropriate linear travel systems should be apparent to those skilled in the art.

Figure 8A:
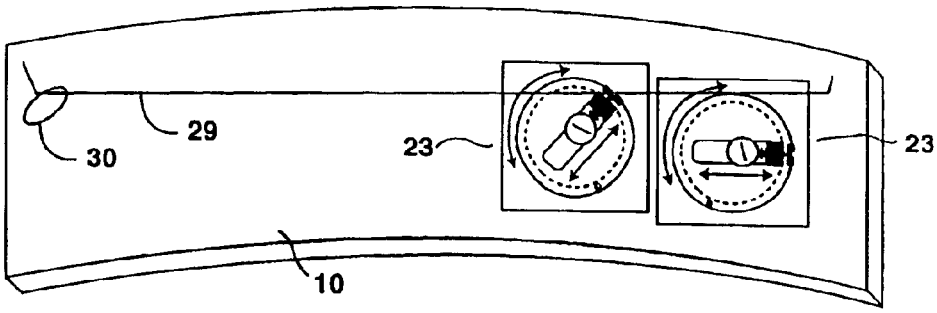
FIG. 8*a* is a rear view of a posterior headrail section with an adjustable curvature slot.
Figure 8B:
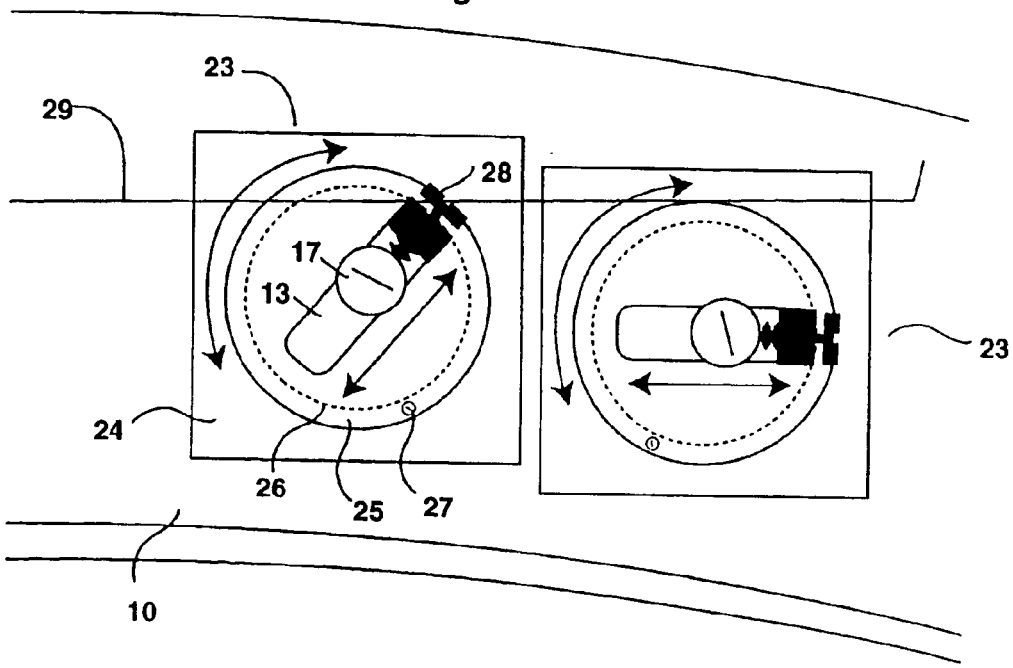
FIG. 8*b* is a detailed partial rear view of z posterior headrail section with an adjustable curvature slot.

One novel system for an adjustable curvature slot 23 is disclosed in FIGS. 8*a* and 8*b*. In this embodiment a large diameter bore hole 26 is made in the posterior headrail section 10, the diameter of which is equal to the maximum travel length of a curvature slot 13 for a specific range of window lintel 5 curvatures. A stationary plate 24 is fixedly attached to the back face of the posterior headrail section 10, centered over the bore hole 26. Inset into the stationary plate 24 is a circular rotating plate 25 which may freely rotate in the stationary plate 24. The rotating plate 25 contains an aperture which is the curvature slot 13. A locking screw 27 on the outer edge of the rotating plate 25 may be tightened against the backside of the posterior headrail section 10 to prevent rotation of the rotating plate 25, thereby fixing the angle A of the curvature slot 13.

The maximum length B of the curvature slot 13 is the same as the diameter of the bore hole 26 and the curvature slot 13 is centered over the bore hole 26 such that as the rotating plate 25 is rotated, the lateral ends of the curvature slot 13 coincide with the circumference of the bore hole 26. The length B curvature slot 13 may be decreased by turning a slot adjustment screw 28, its shaft thereby extending into the curvature slot 13 and decreasing the available travel distance. This novel adjustable curvature slot 23 provides the ability to fit multiple window curvatures without necessity of custom manufacture or provide quick adjustment to account for any irregularities when installing the window shade 2 in the field.

In addition to connecting the anterior headrail sections 9 to the posterior headrail sections 10, the slot pins 17 also slide within and along the length of the curvature slots 13 and the anti-rotation slots 15. This sliding ability allows the sliding headrail 8 to conform to the flat sill 6 of the window frame 4 when the window shade 2 is fully retracted, and also to conform to the arched lintel 5 when the window shade 2 is fully closed. To further facilitate travel within and along the curvature slots 13 and anti-rotation slots 15, a pin bushing 21 is placed around the shafts 19 of the slot pins 17 as shown in FIG. 5. The pin bushing 21 may be any appropriate bearing bushing (needle, roller, ball, etc.) which will reduce any sliding friction between a slot pin 17 shaft 19 and a curvature slot 13 or an anti-rotation slot 15.

FIG. 4*b* shows the curvature slot 13 formed at an angle A from the horizontal respective to the length of a posterior headrail section 10. One way to approximate angle A, within tolerances appropriate to this application, is to use the acute angle formed between a tangent to the arch and a horizontal plane running through the arch at the point of intersection between the arch and a vertical plane running through the resting location of the slot pin 17 in the curvature slot 13 when the sliding headrail 8 rests on the sill 6. An appropriate length B of the curvature slot 13 may be approximated by subtracting the length of the sill 6 from the arc length of the arched lintel 5 and dividing the difference by the number of headrail sections 9 and 10 less one, which is the number of curvature slots 13 in a sliding headrail 8. This allows the curvature slots 13 to expand the sliding headrail 8 from the length of the sill 6 to the arc length of the arched lintel 5. The length B of the curvature slots 13 controls the ability of the sliding headrail to expand and rotate to fit the arch of the lintel 5, as well as collapse and rotate to fit a horizontal sill 6.

Figure 7:
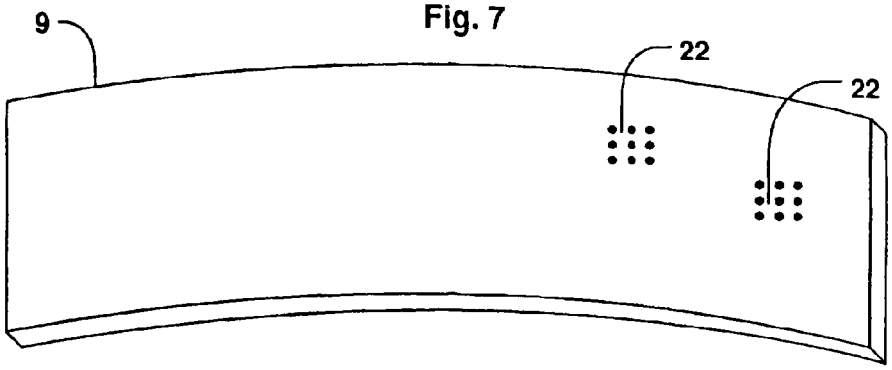
FIG. 7 is a rear view of an anterior headrail section with predrilled guide holes.

The anti-rotation slot 15 is long enough to allow the slot pin 17 in the tandem curvature slot 13 to travel the length B of the curvature slot 13. The length C of the anti-rotation slot 15 therefore is simply the cosign of angle A modified by the length B of the curvature slot 13 in certain applications, it may be appropriate to reduce the anti-rotation slot 15 to nearly a pivot point. Due to the irregularities in construction of windows 1 and window frames 4, it may be easier to manually fit the headrail sections 9 and 10 to the arcuate surface of the window frame 4 and manually create the curvature slot 13 angles A and lengths B, rather than compute them approximately by trigonometry as described above. Manual adjustments can also be facilitated by pre-drilling a grid of numerous guide holes 22 in the back of the anterior headrail sections 9, as shown in FIG. 7, thereby providing multiple attachment points for the slot pins 17.

The anti-rotation slots 15 are used to maintain the horizontal integrity of the sliding headrail 8. Without the anti-rotation slots 15, the slot pins 17 in the curvature slots 13 may act as freely rotating hinges, allowing the headrail sections 9 and 10 to dangle freely from each other. Other means of providing vertical and horizontal movement between headrail sections 9 and 10, without creating a freely rotating pivot, may be substituted. Each anti-rotation slot 15 is placed so that its baseline is parallel to the plane of the horizontal width of the headrail section 9 or 10.

The curvature slots 13 and the anti-rotation slots 15 may be placed in either the anterior headrail sections 9 or the posterior headrail sections 10, or both. For aesthetics, in the described embodiment the slots 13 and 15 are placed only in the posterior headrail sections 10 to create a clean surface on the front of the sliding headrail 8. Additionally, the top edges 11 of the headrail sections 9 and 10 may be planed, carved, cast, molded, or otherwise tooled to conform the sliding headrail 8 to the curvature of the arched lintel 5, creating a more form fitting and aesthetically pleasing window shade 2.

Figure 6A:
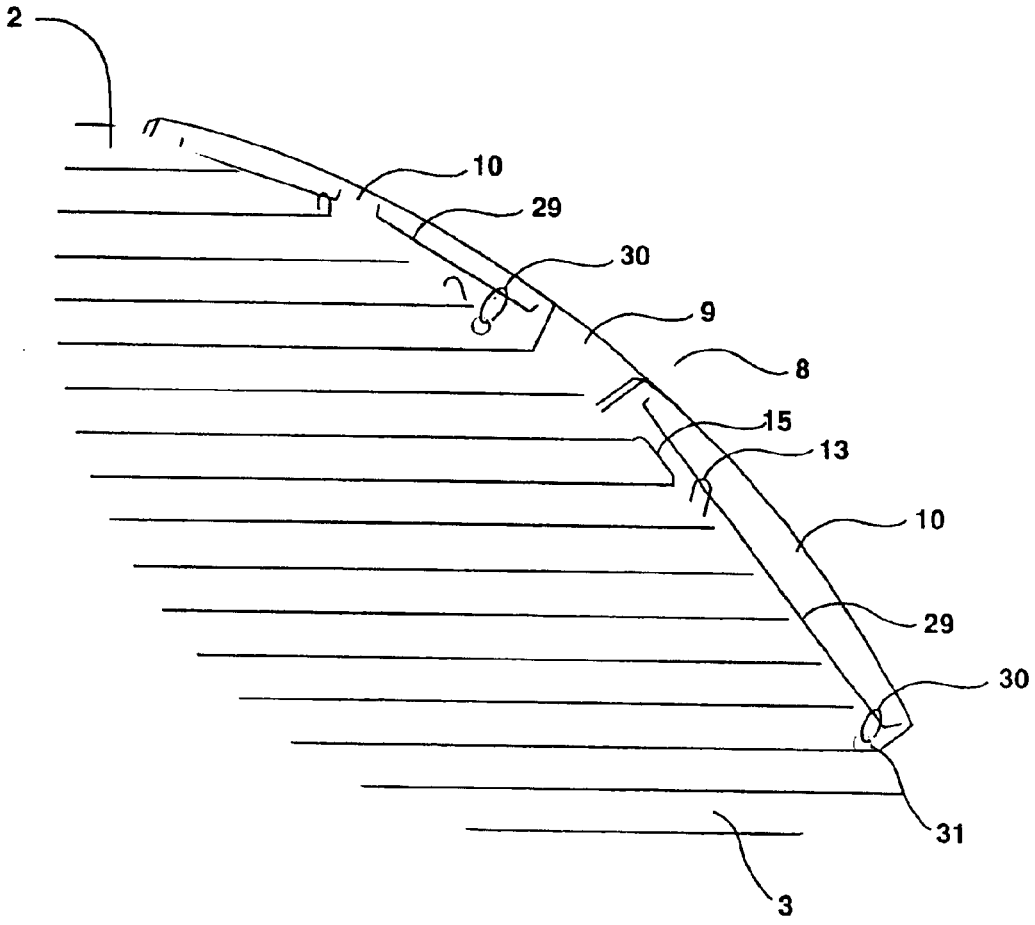
FIG. 6*a* is a partial view of the attachment of blind material to the sliding headrail in an arched embodiment.
Figure 6B:
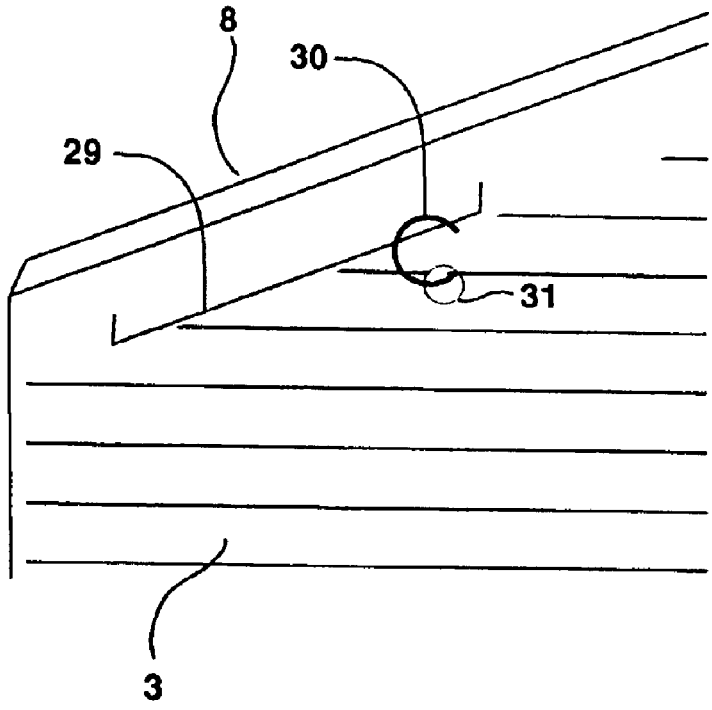
FIG. 6*b* is a partial view of the attachment of blind material to the sliding headrail in a pitched embodiment.

The bottom edge of the shade material 3 is fixedly attached to the sill 6 and along its upper edge the shade material 3 is attached to the sliding headrail 8 via novel shade leveling rods 29 as shown in FIGS. 6*a* and 6*b*. Initially, the upper edge of the shade material 3 is cut or trimmed to fit the shape and curvature of the arched lintel 5. The upper edge of the shade material is then perforated at various points to create eyelet attachment holes 31. The eyelet attachment holes 31 are generally placed at regular intervals along the upper edge of the shade material 3 to distribute the stress placed on the hanging shade material 3. The eyelet attachment holes 31 can additionally be reinforced to further resist the stress placed on each eyelet attachment hole 31. Eyelets 30 are inserted through each eyelet attachment hole 13 and are additionally secured around a corresponding shade leveling rod 29.

The shade leveling rods 29 are fixedly attached to the sliding headrail 8 in counterpart to the location of each eyelet attachment hole 31 in the shade material 3. Each shade leveling rod 29 is of a length long enough to allow the sliding headrail 8 to expand to the length of the arched lintel 5 and contract to the length of the horizontal sill 6, without creating additional stress on the shade material 3. This is accomplished because the eyelet 30 may freely travel along the length of the shade leveling rod 29 as the sliding headrail 8 expands and contracts. Rather than using separate eyelets 30, in some applications it may be preferable to attach the shade material 3 directly to the shade leveling rods 29 via the eyelet attachment holes 31.

The shade leveling rods 29 may be constructed of taught wire, plastic, thin metallic rods, or other similar thin-gauge, rigid, tensilely strong material which will not sag. The shade leveling rods 29 may be mounted on the back of the sliding headrail 29, in this embodiment on the backs of the posterior headrail sections 10, minimally displaced from, rather than flush with, the back surface of the posterior headrail sections 10 to ensure unimpeded travel of the eyelets 30 along the shade leveling rods 29. Other means of attaching the shade material 3 to the sliding headrail 8 which allow for horizontal movement in the positioning of the shade material 3 relative to the sliding headrail 8 may be used as well.

Not only do the shade leveling rods 29 reduce the stress placed upon the shade material 3, they also allow the shade material 3 to remain horizontally centered in the window frame 4. In applications where the shade material 3 is pleated, honeycomb, blinds, or similar material with horizontal pleats or sections, the combination of the sliding headrail 8 and the shade leveling rods 29 maintain the integrity and visual aesthetic of the horizontal attributes of the shade material 3. The present invention thereby avoids the need to fan or bunch shade material 3 to cover the window 1 and additionally prevents fanning or drooping of the lateral edges of the shade material 3 by providing regular support of the upper edge of the shade material 3 with the shade leveling rods 29. In fact the present invention provides support for the shade material 3 over a width nearly as wide as the window 1 itself, allowing for few size restrictions in its application. Another benefit is there is no limitation upon the type of shade materials 3 which can be used. In addition to pleated and honeycomb materials, regular drapery fabric, wood blinds, mini-blinds, roman shades, and other materials may easily be used.

This novel combination of the sliding headrail 8 and shade leveling rods 29 also provides full coverage of the window 1 within the window frame 4 when drawn closed and full retraction when drawn open in one window shade 2, rather than merely partial coverage or the necessity of installation of multiple shades and the utilization of variously fanned and bunched pleated shade material 3 to cover the variously shaped sections of the window 1. In the preferred embodiment, the window shade 2 operates in an "bottom gathering" fashion, wherein the shade material 3 gathers behind the sliding headrail 8 at the sill 6 of the window frame 4 when the window shade 2 is opened. This bottom gathering feature preserves the aesthetic of the arched lintel 5 when the window shade 2 is open and hides the gathered shade material 3 behind the sliding headrail 8 which acts like a valance. Similarly, when the window shade 2 is drawn closed the sliding headrail 8 appears as a valance along the lintel 5 of the window frame 4.

It should be readily apparent, however, that the present invention can be installed in a "top gathering" fashion as well. A top gathering application may preferably use a more resilient shade material 3, such as pleated or honeycomb material, in order to conform to the arch of the lintel 5 when drawn open and still maintain its horizontal integrity without additional fold marks when drawn closed. It should also be readily apparent that the headrail segments may be attached either in front of or behind the shade material depending upon the aesthetic desired by the user.

The window shade 2 is drawn open and closed via a draw cord 35 as shown in FIGS. 1*b* and 1*c*. In the pictured embodiment only a single draw cord 35 is used and it is fixedly attached to the center of the sliding headrail 8 by a draw cord pin 36. The draw cord pin 36 may be a screw, nail, rivet, or other suitable means for attaching a draw cord 35 to the sliding headrail 8. The draw cord 35 is preferably drawn through a series of pulleys or similar mechanisms widely known and used in the window shade trade, to route the draw cord 35 within the window frame 4 to provide a user easy access to the end of the draw cord 35 to raise and lower the window shade 2. The user end of the draw cord may be appended with a tassel 50 for ease of grasping by the user. The draw cord 35 may additionally be operated via the use of any of numerous commercially available motorized blind operators which have a variety of features such as remote control or automatic timing systems.

One of the pulley positions is preferably in the center of the lintel 5 to allow the sliding headrail 8 to be raised and lowered at its horizontal center, thereby maintaining the balance of the sliding headrail 8 and the horizontal center of the window shade 2 within the window frame 4. Depending upon the dimensions of the window, additional draw cords 35 may be utilized, attached at various intervals along the sliding headrail 8 to facilitate the raising and lower of the window shade 2 and reduce the stress placed upon a single draw cord 35 or a single point on the sliding headrail 8.

In addition, guide wires 32 may be used to ensure the window shade remains centered in the window frame 4. As seen in FIGS. 1*a* and 2, the shade material 3 is additionally perforated with guide wire holes 33 vertically in folds along its center and lateral edges to accommodate the threading of guide wires 32 through it. The guide wires 32 are fixedly attached to the lintel 5 and sill 6 to maintain a taught orientation within the plane of the window frame. The shade material 3 slides along the guide wires 32 as the window shade 2 is raised and lowered, ensuring the window shade 2 remains centered in the window frame 4. Draw cords 35 and guide wires 32 may be made of a variety of materials including metal wire, cord, monofilament—transparent or opaque—depending on the preference of the user. The guide wires 32 could additionally be rigid rods. The sliding headrail 8 may additionally have one or more guide wire guides 34 fixedly attached to it, through which the guide wires 32 are additionally threaded. Such guide wire guides 34 may help prevent the sliding headrail 8 from tipping out of the plane of the window frame 4 especially when resting on the sill 6. Additionally, a false sill box might be installed, similar to a planter box, to enclose the sliding headrail 8 and gathered shade material 3 when resting on the sill 6 to prevent tipping.

Figure 10A:
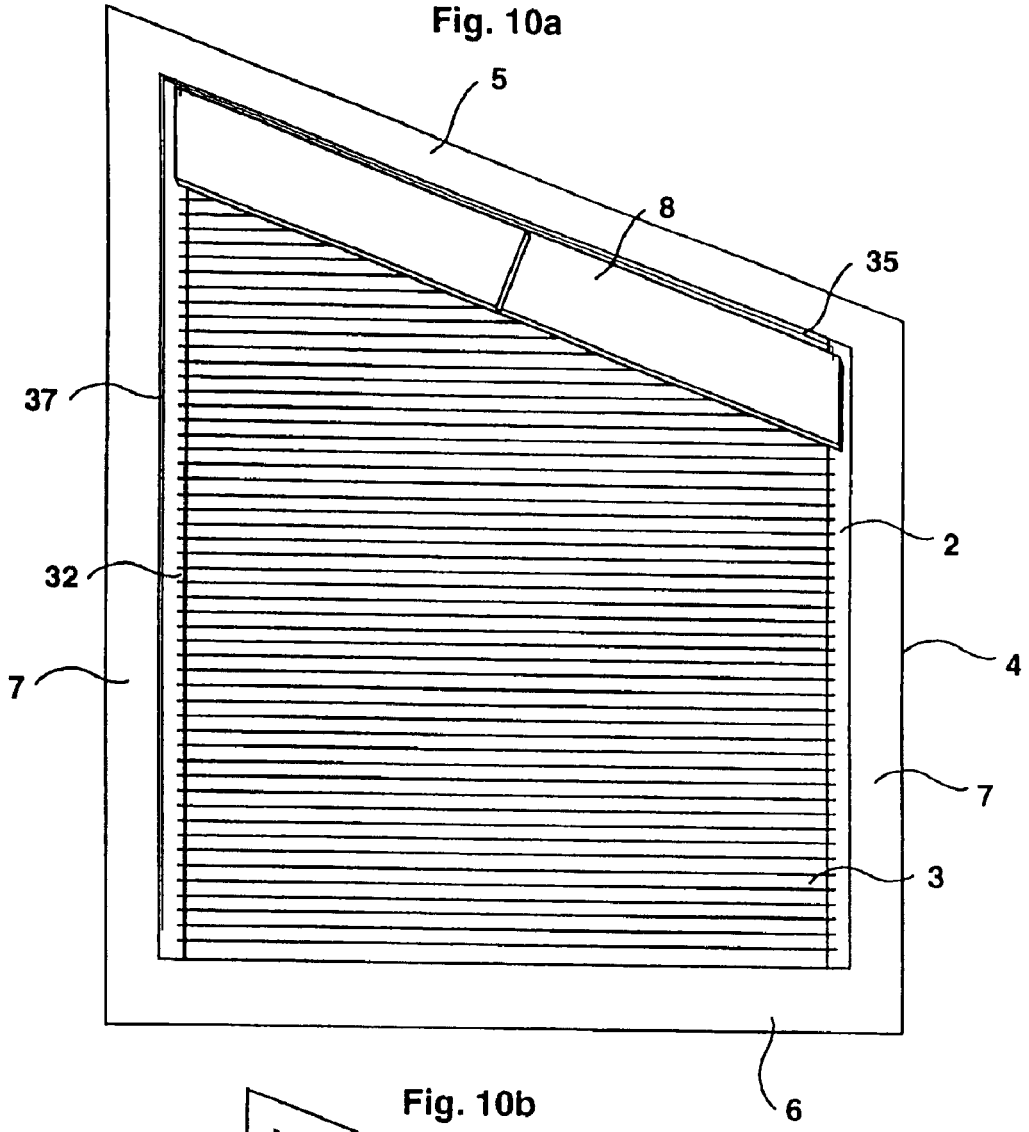
FIG. 10*a* is a front view of a trapezoidal embodiment of the present invention for use with a pitch lintel with the shade fully closed.
Figure 10B:
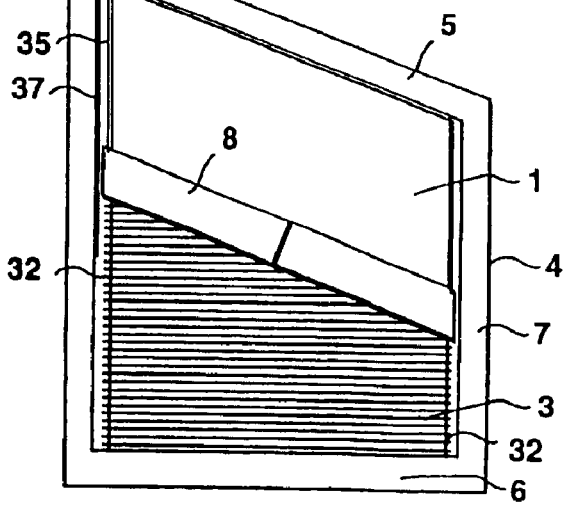
FIG. 10*b* is a front view of a trapezoidal embodiment of the present invention for use with a pitch lintel with the shade partially closed.
Figure 10C:
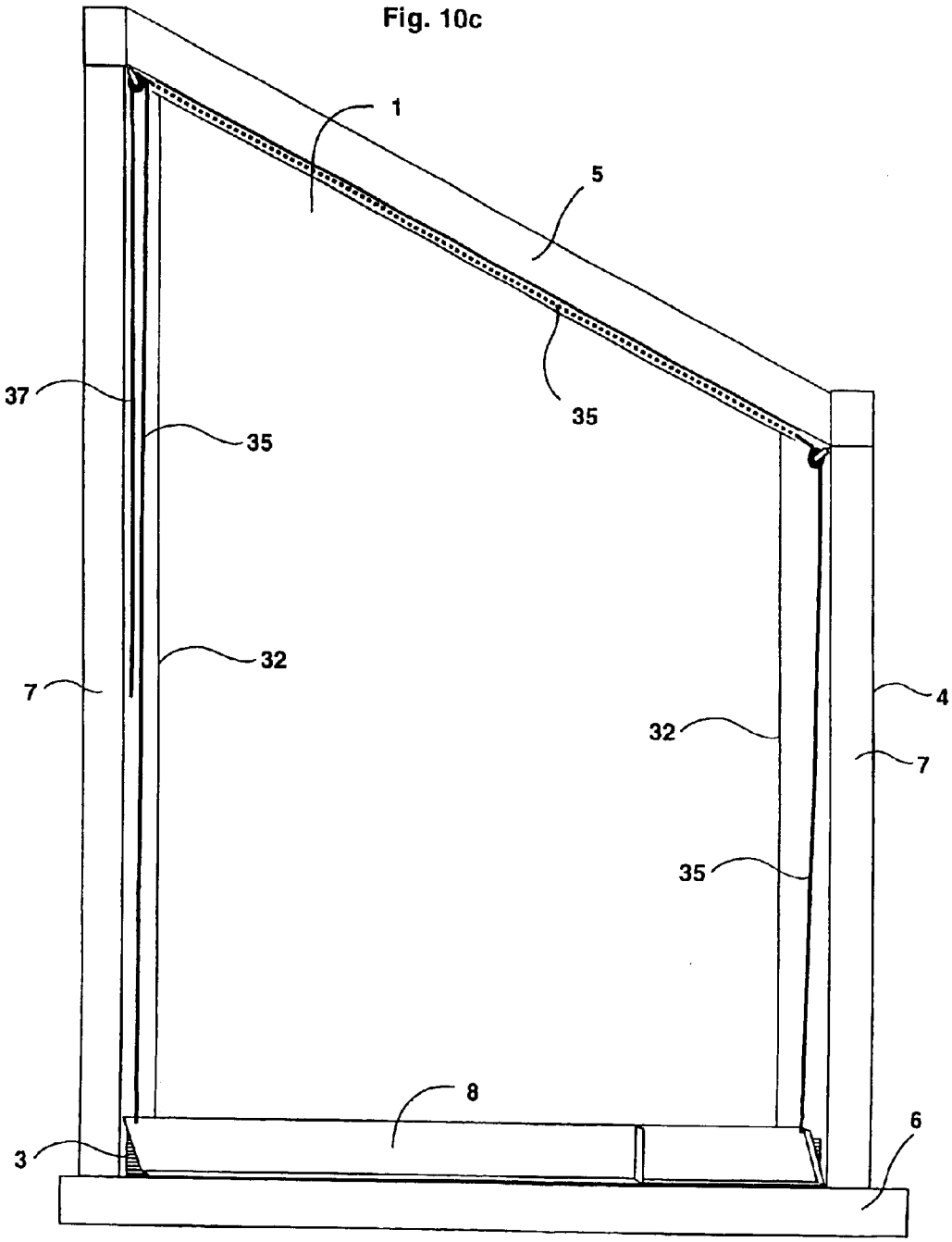
FIG. 10*c* is a front view of a trapezoidal embodiment of the present invention for use with a pitch lintel with the shade fully open.

FIGS. 10*a*, 10*b*, and 10*c* disclose a second embodiment of the present invention for application in windows with pitched lintels. The sliding headrail 8 may generally be constructed of fewer sections for this application. Only two sections are depicted in FIGS. 10*a*, 10*b*, and 10*c*, however more may be useful in application in extremely wide windows. The sliding headrail 8 is composed of essentially the same components as in the arched window application. It generally operates in a bottom gathering fashion wherein the shade material 3 is fixedly attached to the sill 6 and is attached to the sliding headrail 8 via eyelets 30 and shade leveling rods 29. Shade leveling rods 29 in this embodiment are attached to the anterior headrail section 9 as well as the posterior headrail section 10 as in FIGS. 6*b* and 11. Guide wires 32 fixedly attached to the lintel 5 and sill 6 and threaded through perforated guide wire holes 33 in the lateral edges of the shade material 3 may be employed as well to ensure proper positioning in the window frame 4.

Figure 11:
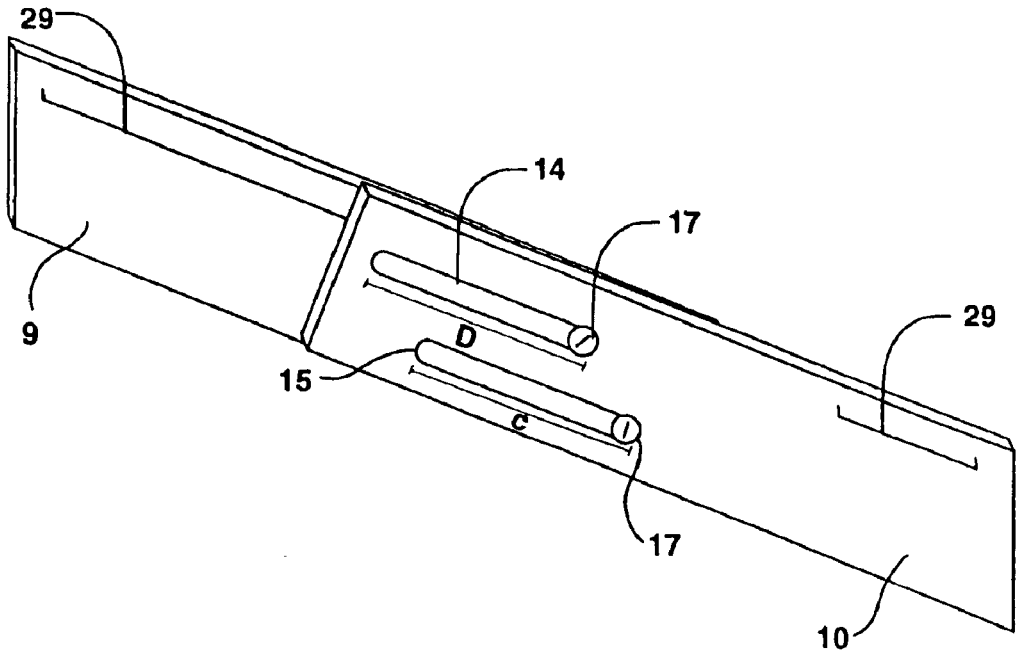
FIG. 11 is a rear view of the sliding headrail mechanism in a trapezoidal embodiment.

The major difference in construction of the sliding headrail 8 in the pitched lintel application is that travel slots 14 are used in place of curvature slots 13 as seen in FIG. 11. Rather than being angled with reference to the horizontal length of the posterior headrail section 10, the travel slot 14 is parallel to that same horizontal plane. The length D of the travel slot 14 is the difference between the length of the lintel 5 and the sill 6, thereby allowing the sliding headrail 8 to expand and contract to fill the width of the window frame 4 whether adjacent to the lintel 5 or sill 6. If more than two sections for the sliding headrail 8 are used, then the lengths of the travel slots 14 should each be the difference between the length of the lintel 5 and the sill 6, divided by the number of headrail sections 9 and 10 less one. An anti-rotation slot 15, adjacent and parallel to the travel slot 14, is still preferred to maintain horizontal rigidity and prevent the travel slot 14 from becoming a freely rotating pivot or hinge. The length C of the anti-rotation slot 15 is the same as length D of the travel slot 14 to allow for the expansion and contraction of the sliding headrail 8.

Figure 15A:
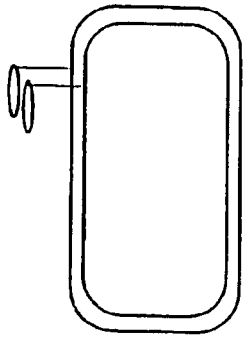
FIG. 15*a* is a side view of a telescoping sliding headrail.
Figure 15B:
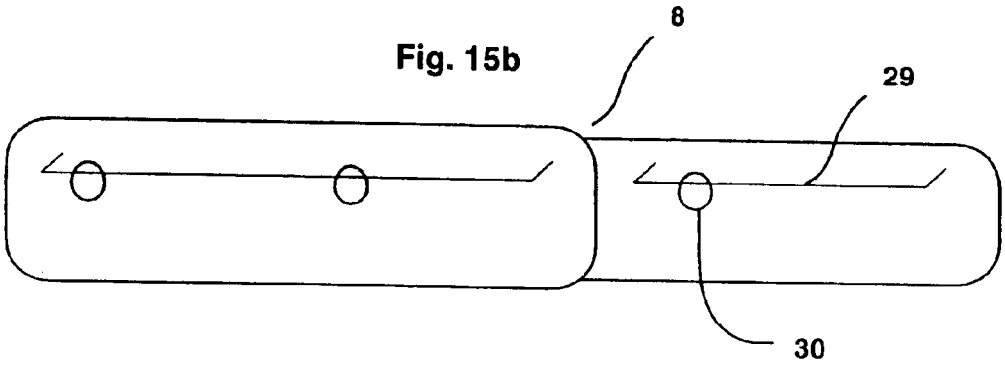
FIG. 15*b* is a front view of a telescoping sliding headrail.
Figure 15C:
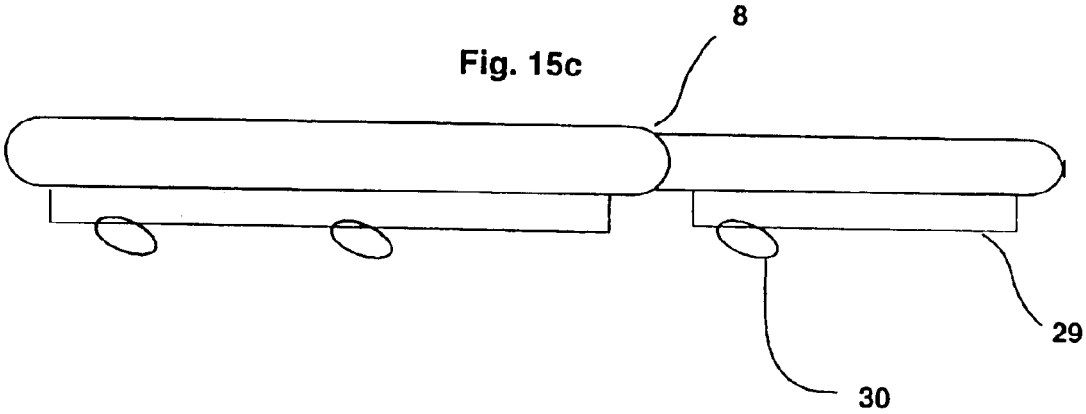
FIG. 15*c* is a top view of a telescoping sliding headrail.

Due to the linear nature of the travel between the headrail sections 9 and 10 in this embodiment, it should be apparent that a telescoping system may be substituted to achieve the same results as shown in FIGS. 15*a*, 15*b*, and 15*c*. Any appropriate tubular or channeled materials capable of nesting together can be substituted for the use of the travel slots 14 and anti-rotation slots 15.

The window shade 2 in the pitched lintel application will generally utilize two draw cords 35, each attached to a lateral end 12 of the sliding headrail 8 as depicted in FIG. 10*c*. The draw cords 35 may be connected to each other via a cord connector 48, as in FIG. 10*d* to provide the user with simply a single pull cord 37 to operate the window shade 2. Since the vertical travel distance of one lateral end 12 of the sliding headrail 8 is longer than the other lateral end 12, the lengths of the respective draw cords 35 may be appropriately adjusted to provide for even raising and lowering of the window shade 2. Several options to achieve this are well known in the art, including leaving slack in one draw cord 35, incorporating an elastic section into one of the draw cords 35 to compensate for the additional travel distance of the second draw cord 35, or using a system of spring loaded pulleys through which a draw cord 35 is threaded and which take up slack under tension. If slack is left in one draw cord 35, a cord stop 49 may be placed on the user end of this draw cord 35 such that when attached lateral end 12 of the sliding headrail 8 just reaches the sill 6, the cord stop 49 reaches the lintel 5 and prevents further lowering of the draw cord 35 attached to that lateral end 12 of the sliding headrail 8.

Another method is to join the ends of the draw cords 35 around a pulley wheel which is connected to the pull cord 37. In this manner, when the movement of the draw cord 35 with the shorter travel distance is arrested by the sliding headrail 8 reaching the lintel 5, the pulley wheel will allow the draw cord 35 with the greater travel distance to continue to be drawn by the pull cord 37. A further method is the use of a tension spring retraction device which plays out excess draw cord 35 once the lateral end 12 with the shorter travel distance is raised, and coils the slack in the draw cord 35 as this same end is lowered toward the sill 6.

Figure 10D:
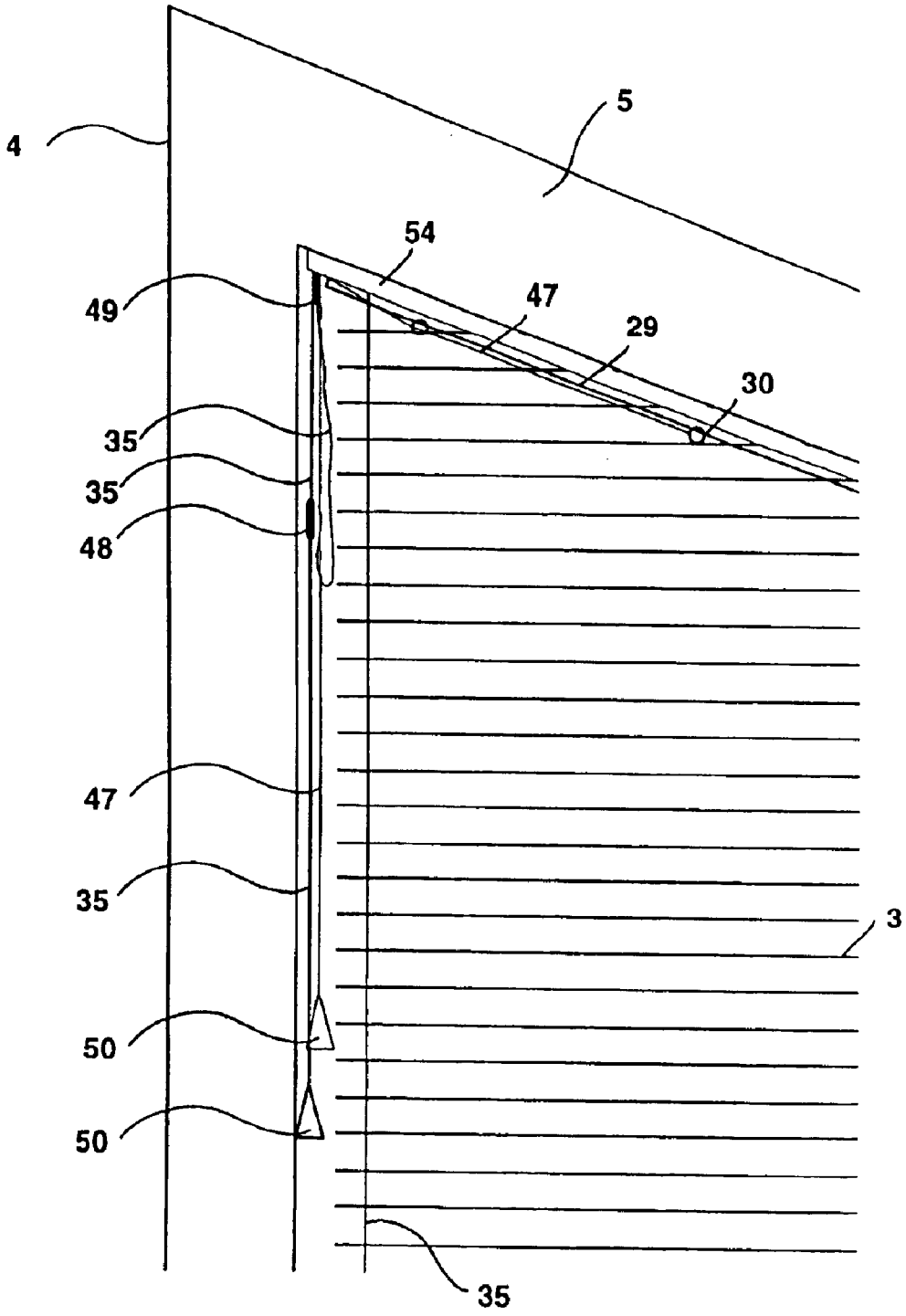
FIG. 10*d* is a front view of a trapezoidal embodiment of the present invention detailing a lintel mounted shade leveling rod, a cord connector, a cord stop, and a shade centering cords.

In a pitched lintel application with a high degree of slope or of very long width, the shade material 3 may tend to slide toward the lower side of the lintel 5 along the shade leveling rod 29 due to the weight of the shade material 3 or the significant slope. This may occur even if guide wires 32 are used. A solution to this problem, as shown in FIG. 10*d* is to attach a shade centering cord 47 to the eyelets 30 along the shade leveling rod 29. The shade centering cord 47 is routed to the higher side of the lintel 5 and down the side of the window frame 4 for easy access by a user. A user may simply pull the shade centering cord 47 which pulls the eyelets 30 along the shade leveling rod 29 toward the peak of the lintel 5, thereby centering the shade material 3 in the window 1. The shade centering cord 47 is then locked in place via a standard cord engagement mechanism, tying the cord to a cleat mounted in the window frame, or through any other well known manner.

Similar to the arched lintel application, the pitched lintel window shade 2 maintains the horizontal integrity of the shade material 3 and prevents any bunching or fanning of pleated or honeycomb materials. Unlike the arched lintel application, there is no limitation on the type of shade materials 3 which may be used in a top gathering application in a pitched lintel. For aesthetic purposes, the lateral ends 12 of the sliding headrail 8 may additionally be trimmed to parallel the lateral sides 7 of the window frame 4 when the window shade 2 is raised toward the pitched lintel 5 and the sliding headrail 8 expands. See FIG. 10*b*.

Figure 12A:
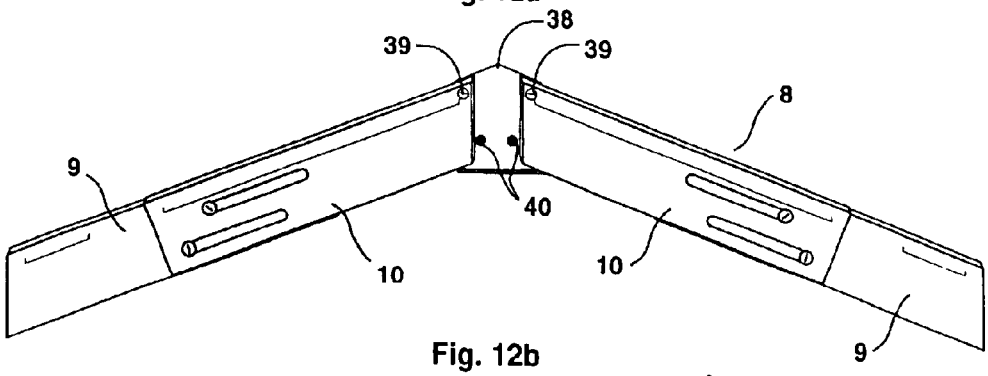
FIG. 12*a* is a rear view of the sliding headrail with a hinge plate for a peaked lintel application in a peaked position.
Figure 12B:
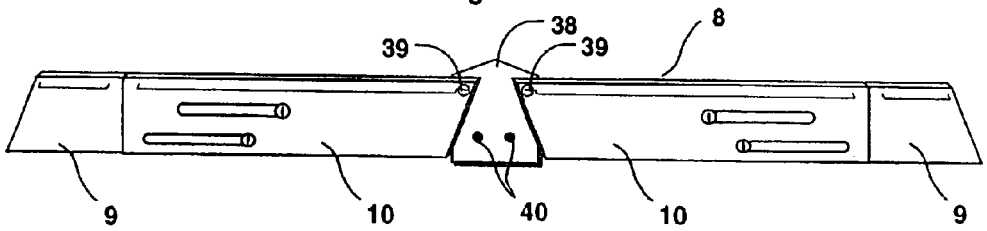
FIG. 12*b* is a rear view of the sliding headrail with a hinge plate for a peaked lintel application in a flat position.
Figure 12C:
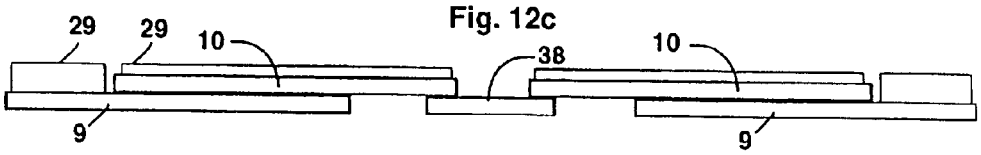
FIG. 12*c* is top view of the sliding headrail with a hinge plate for a peaked lintel application.

The pitched lintel embodiment of the sliding headrail 8 may be modified to accommodate peaked and triangular windows as shown in FIGS. 12*a*, 12*b*, and 12*c*. This is accomplished by inserting a hinge plate 38 between posterior headrail sections 10. The interior ends of the posterior headrail sections 10 are each attached to the hinge plate 38 via limited pivot hinges 39, respectively. The limited pivot hinges 39 allow the posterior headrail sections 10 to rotate downward but prevent any rotation upward beyond the horizontal. Downward rotation is stopped by means of hinge stops 40 which cause the posterior headrail sections 10 to halt their rotation at an angle conforming to the pitch of the peaked sides of the lintel 5. The top of the hinge plate 38 may be contoured such that it too fits the peak of the lintel 5.

Figure 9:
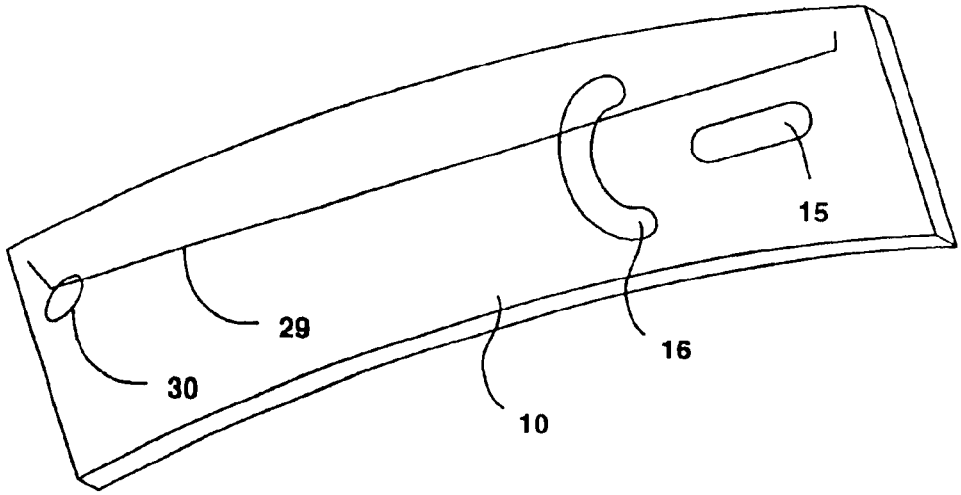
FIG. 9 is a rear view of a posterior headrail section with an arcuate curvature slot.
Figure 13:
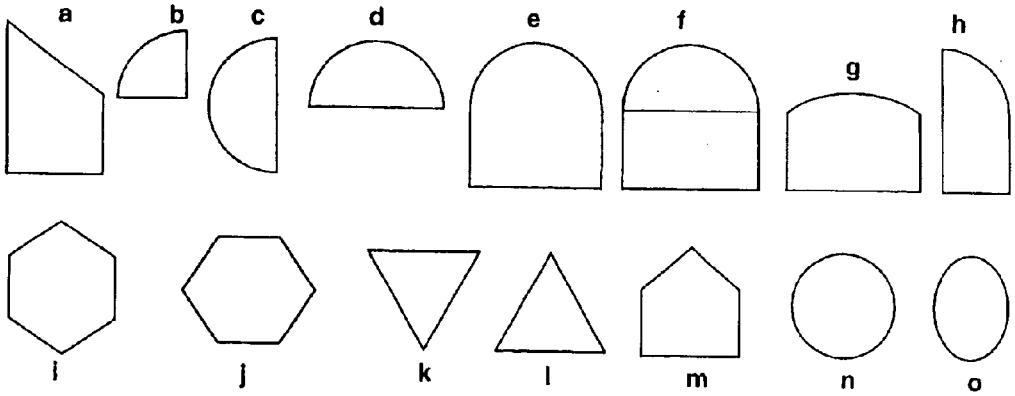
FIGS. 13*a–o* are various window shapes for which the present invention can be Li adapted to provide operable window shades.

FIG. 13 is a collection of window shapes to which the present invention may be easily adapted to provide window shades 2. These adaptations should be obvious to those skilled in the art after review of the embodiments of the invention disclosed herein. Specifically referring to FIGS. 13*c*, 13*n*, and 13*o*, the curvature slots 13 in the posterior headrails 10 may be arcuate slots 16, as shown in FIG. 9, to allow for a reversal of the arched configuration of the sliding headrail 8. Additionally, in reference to FIGS. 13*i* and 13*j*, the limited hinges 39 of hinge plate 38 may be reversibly limited to allow the sliding headrail 8 to conform to both a peaked lintel and a peaked sill.

Figure 14A:
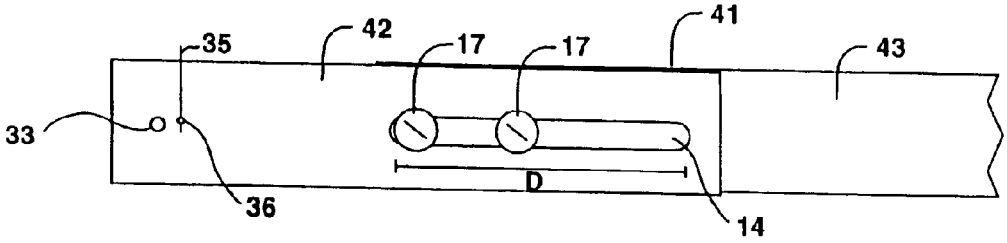
FIG. 14*a* is a partial top view of a horizontal sliding headrail embodiment.
Figure 14B:
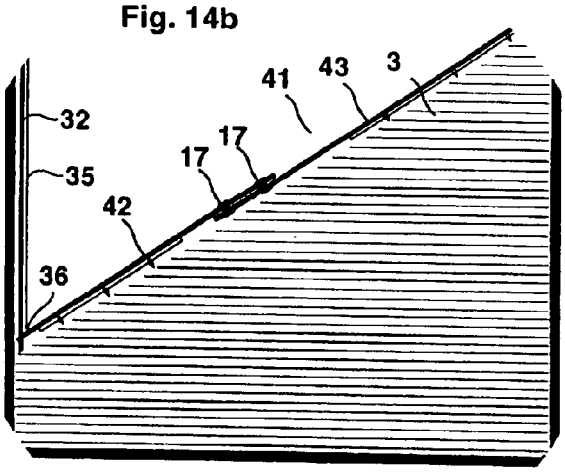
FIG. 14*b* is a partial view of a pitched window shade using the horizontal sliding headrail embodiment.
Figure 14E:
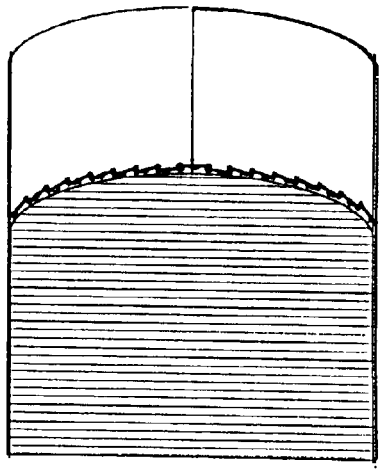
FIG. 14*e* is a view of an arched window with a horizontal sliding headrail embodiment and the shade partially closed.
Figure 14C:
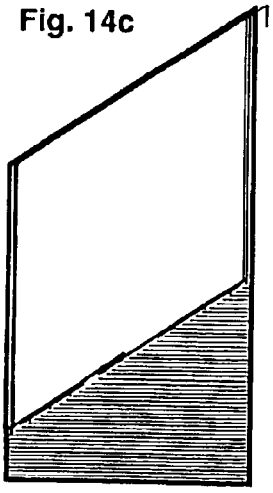
FIG. 14*c* is a view of a pitched window with a horizontal sliding headrail embodiment and the shade partially closed.
Figure 14D:
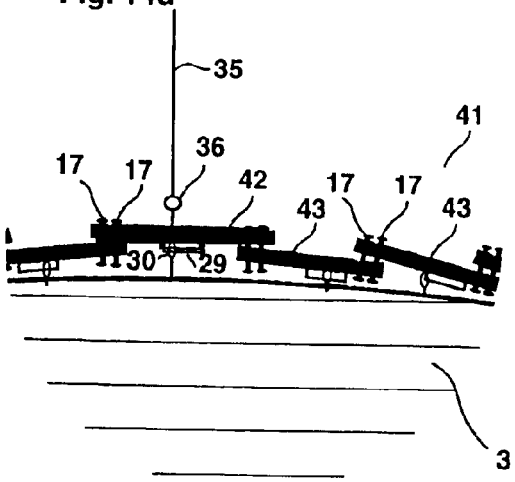
FIG. 14*d* is a partial view of an arched embodiment of the horizontal sliding headrail.

Another embodiment incorporating a horizontal construction of the present invention is disclosed in FIGS. 14*a*, 14*b*, and 14*c*. In this embodiment, instead of overlapping in a vertical plane, the upper headrail sections 42 and lower headrail sections 43 overlap in horizontal layers. Rather than utilizing two separate slots per connection between upper headrail sections 42 and lower headrail sections 43, the horizontal sliding headrail 41 functions with one travel slot 14. Two slot pins 17 are used within each travel slot 14, each controlling the length of expansion and contraction of the horizontal sliding headrail 41, and the combination preventing rotation along the horizontal plane of the horizontal sliding headrail 41. In a pitched lintel application, the length of the slot pins 17 are chosen to allow minimal displacement between the upper headrail section 42 and the lower headrail section 43. In an arched lintel application the length of the slot pins 17 are sized to create greater displacement between the upper headrail sections 42 and lower headrail sections 43 which allows the headrail sections 42 and 43 to tilt against or cascade off one another, thereby creating the arched form when drawn upwards off the sill 6. As this configuration is not as aesthetically pleasing as a vertical sliding headrail 8 embodiment, it is less preferred although functional.

Figure 16:
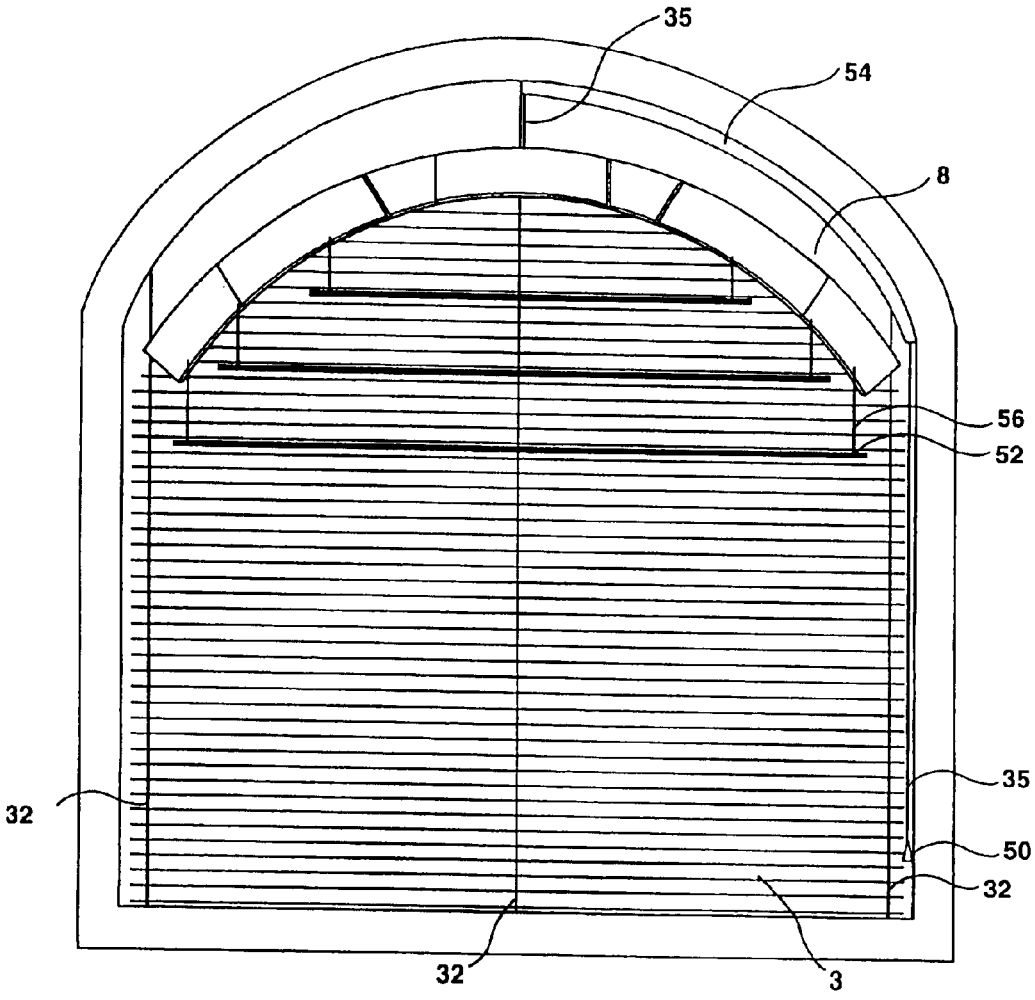
FIG. 16 is a rear cut-away view of a rear mounted sliding headrail in an arched application incorporating support rods within the shade material.
Figure 23:
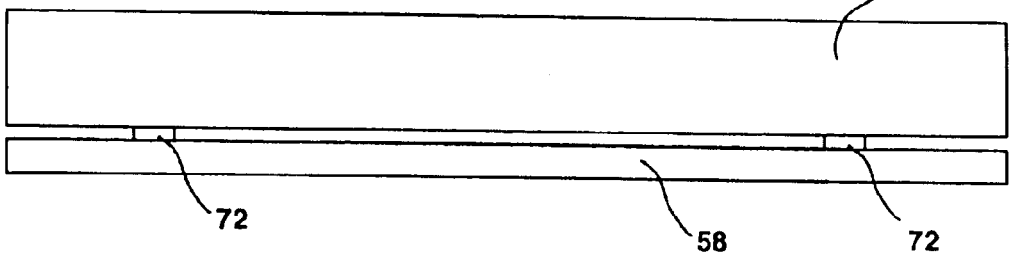
FIG. 23 is a top view of a single headrail segment with and attached valance.

A further embodiment incorporating additional support for the shade material is shown in FIGS. 16, 17, 18, 19 and 23. In FIGS. 16 and 23, support rods 52 are inserted along the interior of honeycomb-type shade material 3. A slit 53 or other opening is cut into shade material 3 to allow for attachment of support rod cords 56 at various points along a support rod 52. Support rod cords 56, similar to draw cords 35 and guide wires 32, may be made of metal wire, cord, monofilament or any similar flexible, tensilely strong material. The opposite end of each support rod cord 56 is attached to a point on the headrail section 9 or 10 directly above the attachment point on the support rod. Attachment means for the support rod cord 56 to either the support rod 52 or a headrail section 9 or 10 may consist of tying, adhesing, pinning, bolting, screwing, nailing, or any other well known means of suitably fastening the support rod cord 56 material. Support rods 52 may be used with other shade materials 3 by fastening the support rods 52 to the shade material 3 through other means such as adhesive, fabric loops, stitching, or other similarly suitable means.

Figure 17:
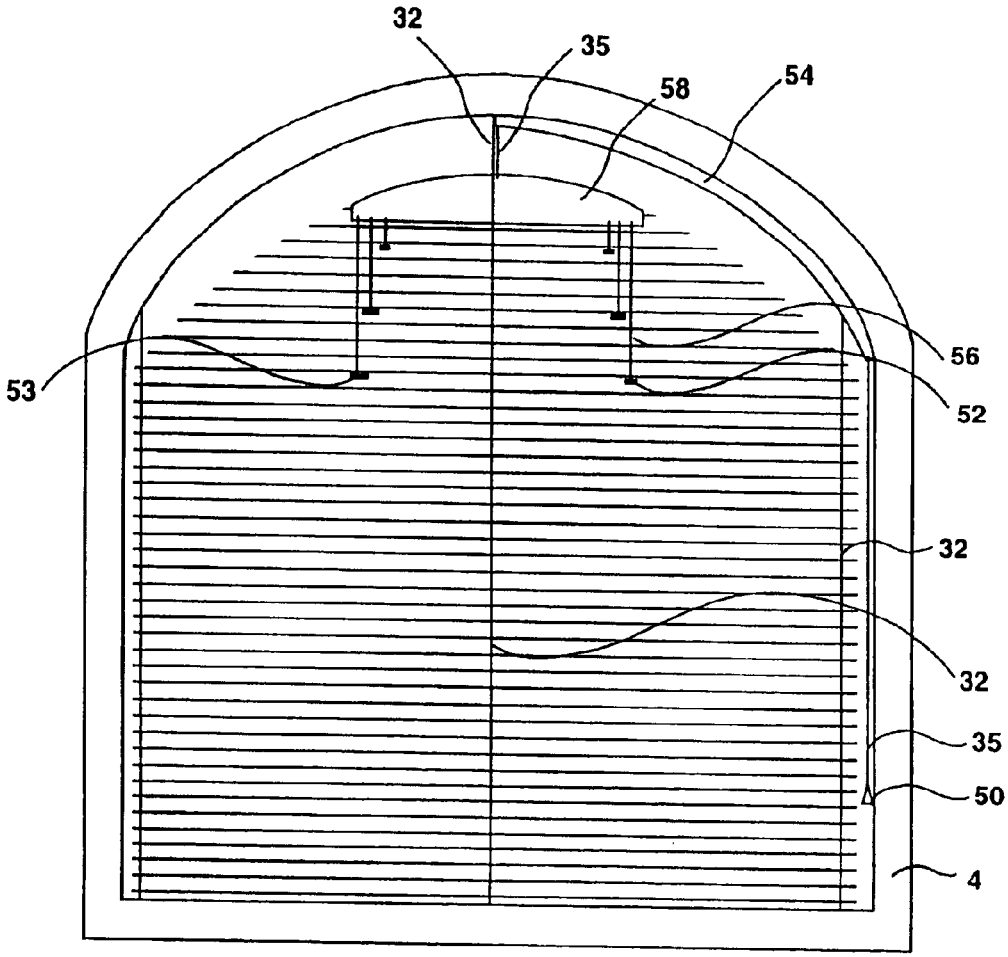
FIG. 17 is a rear view or a rear mounted single headrail in an arched application incorporating support rods.
Figure 18:
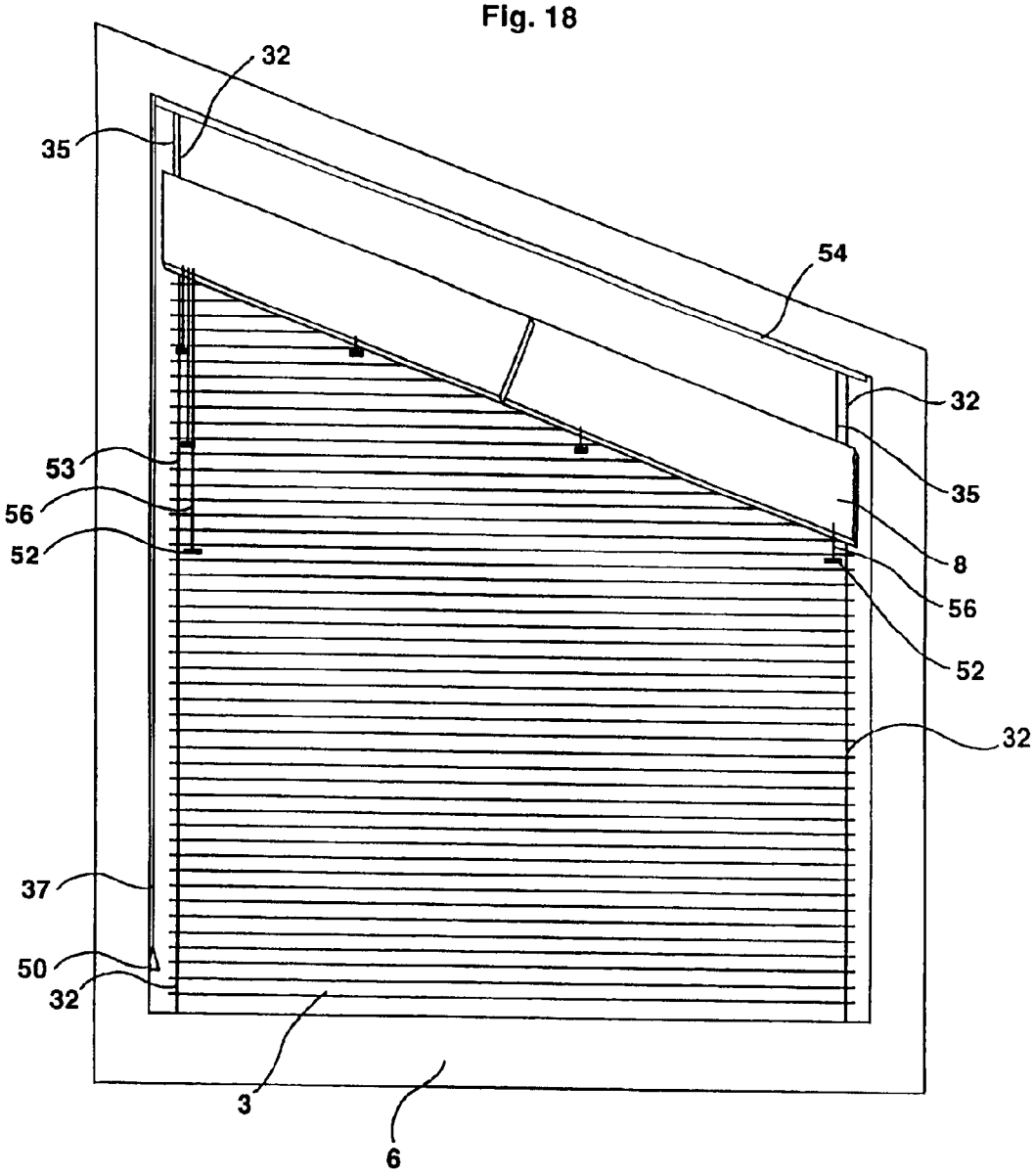
FIG. 18 is a rear view of a rear mounted sliding headrail in a pitched application incorporating support rods.
Figure 19:
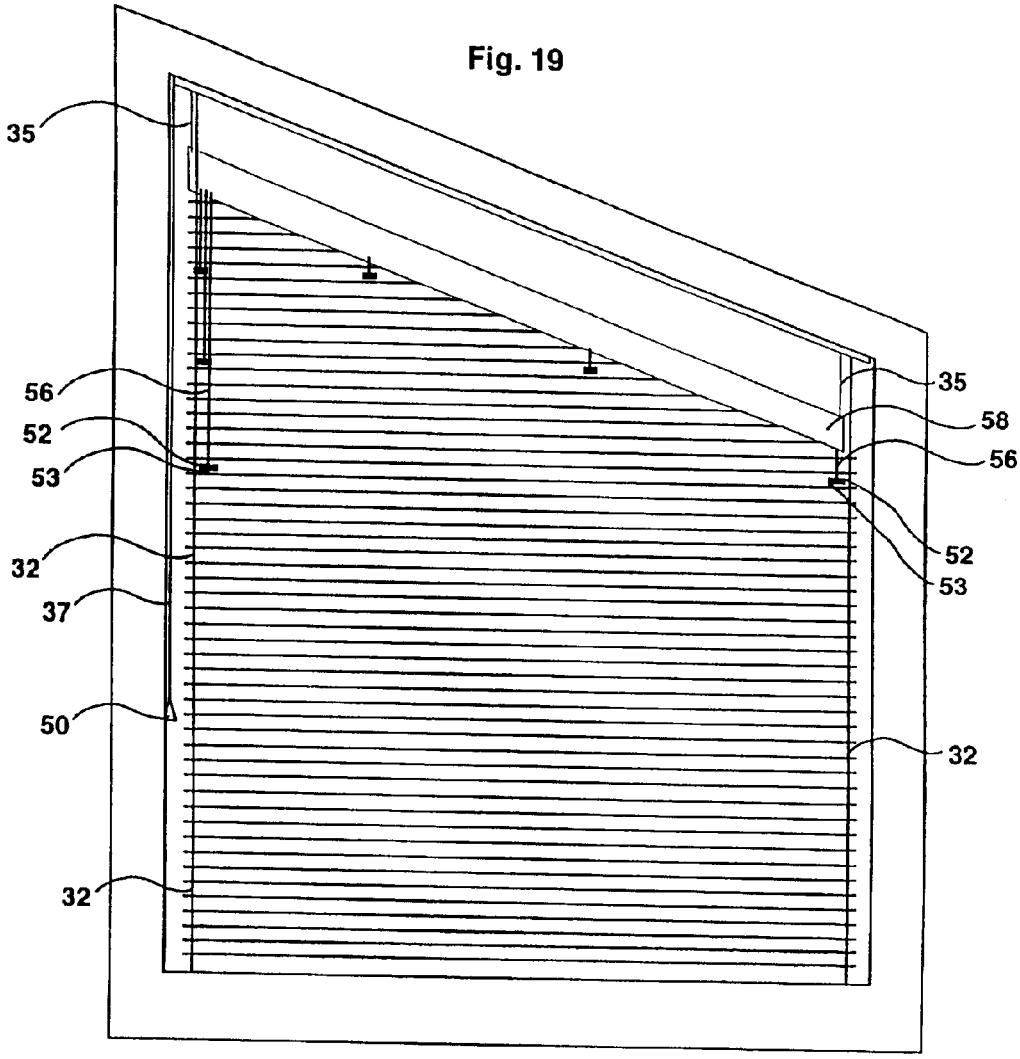
FIG. 19 is a rear view of a rear mounted single headrail in a pitched application incorporating support rods.

The support rods 52 may be composed of most any suitable lightweight, rigid material such as wood, plastic, metal, resin, composite, or other similar material. The support rods 52 may run the width of the shade material 3, or they may be of any shorter length suitable for providing support to the shade material 3. When the sliding headrail 8 is raised, the support rod cords 56 become taught and lift the support rods 52, thereby lifting the shade material 3. By utilizing support rods 52 at various heights on the shade material 3, the stress on any one portion of the shade material 3, for example at the eyelet attachment holes 31 along the top edge, is reduced and distributed throughout the shade material 3. The support rods 52, additionally help the shade material 3 lay flat on the sill 6 when the window shade 2 is open due to the additional weight of the support rods 52 laying on the shade material 3. FIGS. 17, 18, and 19 show the support rods used in single headrail and pitched lintel applications.

Figure 26A:
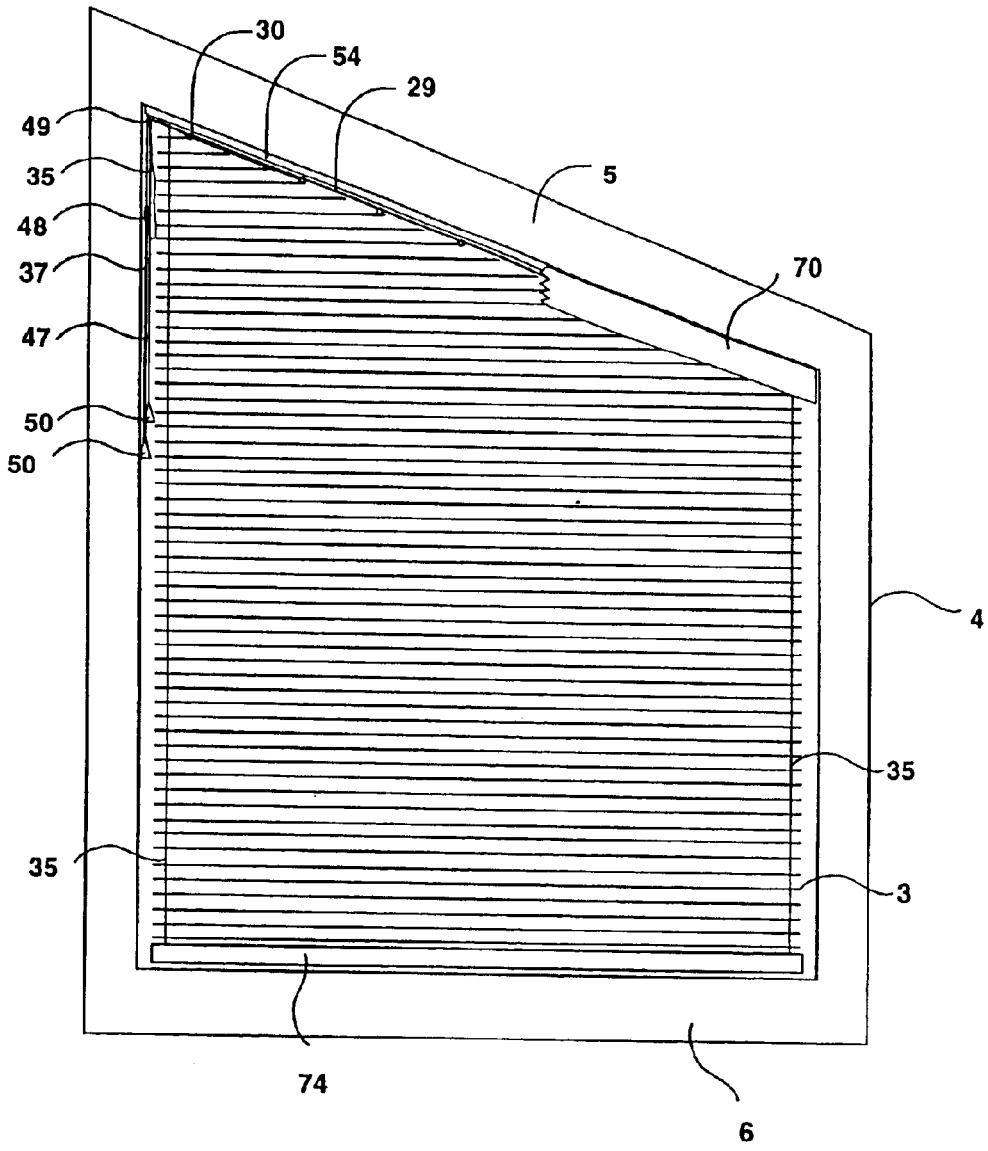
FIG. 26*a* is a front view of an embodiment combining a shade leveling rod with a weighted support rod in a pitch lintel application with the shade closed.
Figure 26B:
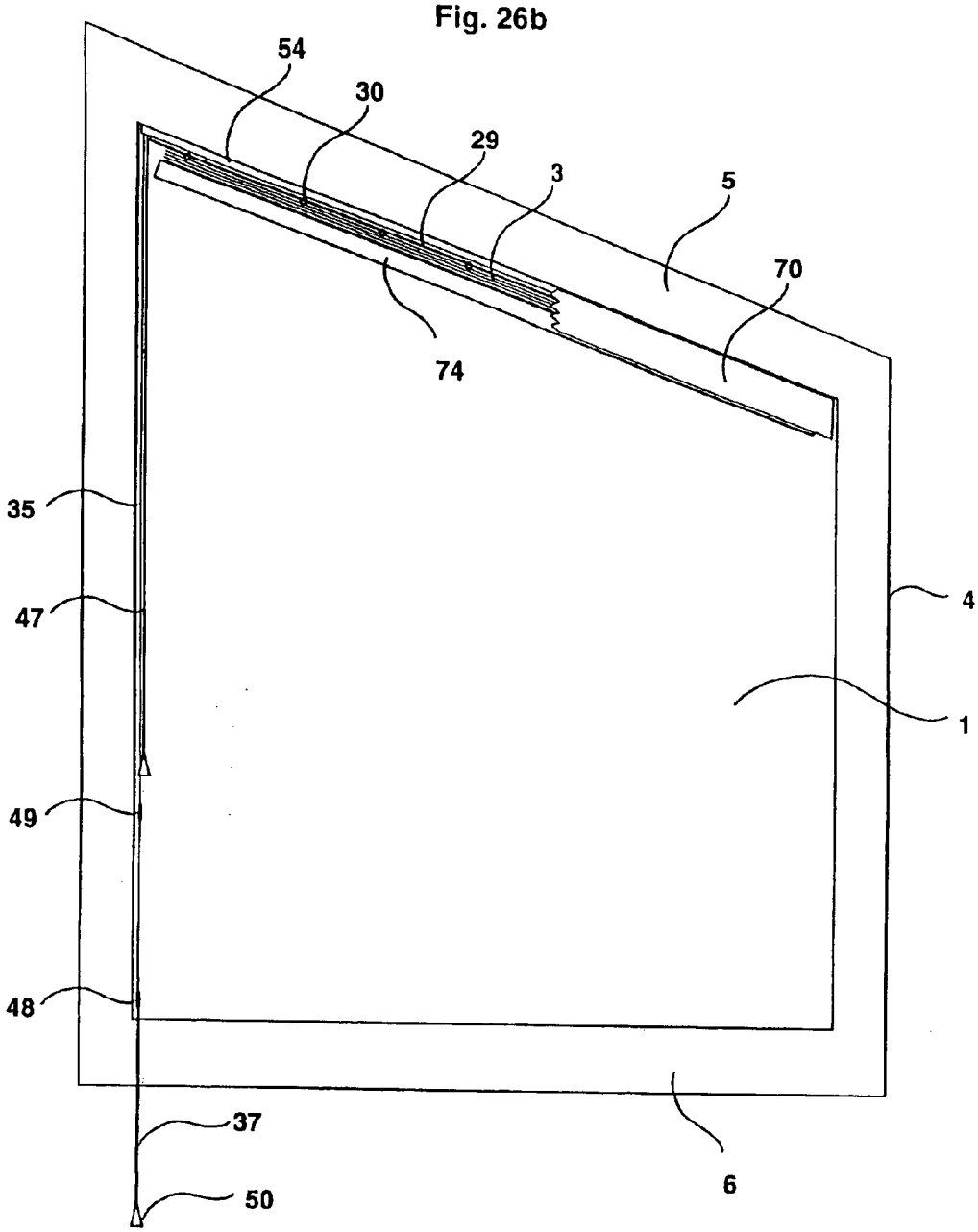
FIG. 26*b* is a front view of an embodiment combining a shade leveling rod with a weighted support rod in a pitch lintel application with the shade open.

Another embodiment in a lintel 5 mounted application as seen in FIGS. 26*a* and 26*b* incorporates the shade leveling rod 29 and uses a bottom rail 74 disposed along the bottom edge of the shade material 3. The top edge of the shade material 3 is attached via eyelets 30 to one or more shade leveling rods 29 mounted to the lintel 5. This provides for free lateral movement of the shade material 3 along the lintel 5 as the window shade 2 is drawn open toward the lintel 5.

The bottom rail 74 may be similar to the support rods 52 of FIGS. 17–19 and 24 including composition and attachment means. The bottom rail 74 is generally heavier than support rods 52 in order to ensure the bottom edge of the shade material 3 lays upon the sill when the window shade 2 is fully closed. Distinct from the support rod 52 embodiment, draw cords 35 are attached to the bottom rail 74 to raise or lower the bottom edge of the shade material 3. Draw cords 35 are joined to pull cord 37 via cord connector 48 for ease of use by a user.

In a pitched lintel application, as in FIGS. 26*a* and 26*b*, there may be merely a single bottom rail 74 running the length of the bottom edge of the shade material 5. In lieu of any special manufacture, a standard bottom rail as found on most window shades 2 may also suffice. Draw cords 35 may be connected to the bottom rail 74 toward the lateral edges of the shade material 3. As the window shade 2 is opened and the bottom of the shade material 3 approaches the lintel 5, a first lateral edge of the bottom edge of the shade material 3 will reach the lintel 5 before the opposite lateral edge. When the first lateral edge of the bottom edge reaches the lintel 5, further movement of the respective draw cord 35 is arrested. Then as the opposite edge continues to travel toward the lintel 5 at the highest point of the pitch, the upper edge of the shade material 3 is free to travel along the shade leveling rod 29. In this manner, the shade material 3 is not stretched or stressed as the shade material 3 is pulled toward the highest point of the pitch due to the greater length of the lintel 5 as compare to the width of the window frame 4.

Figure 27A:
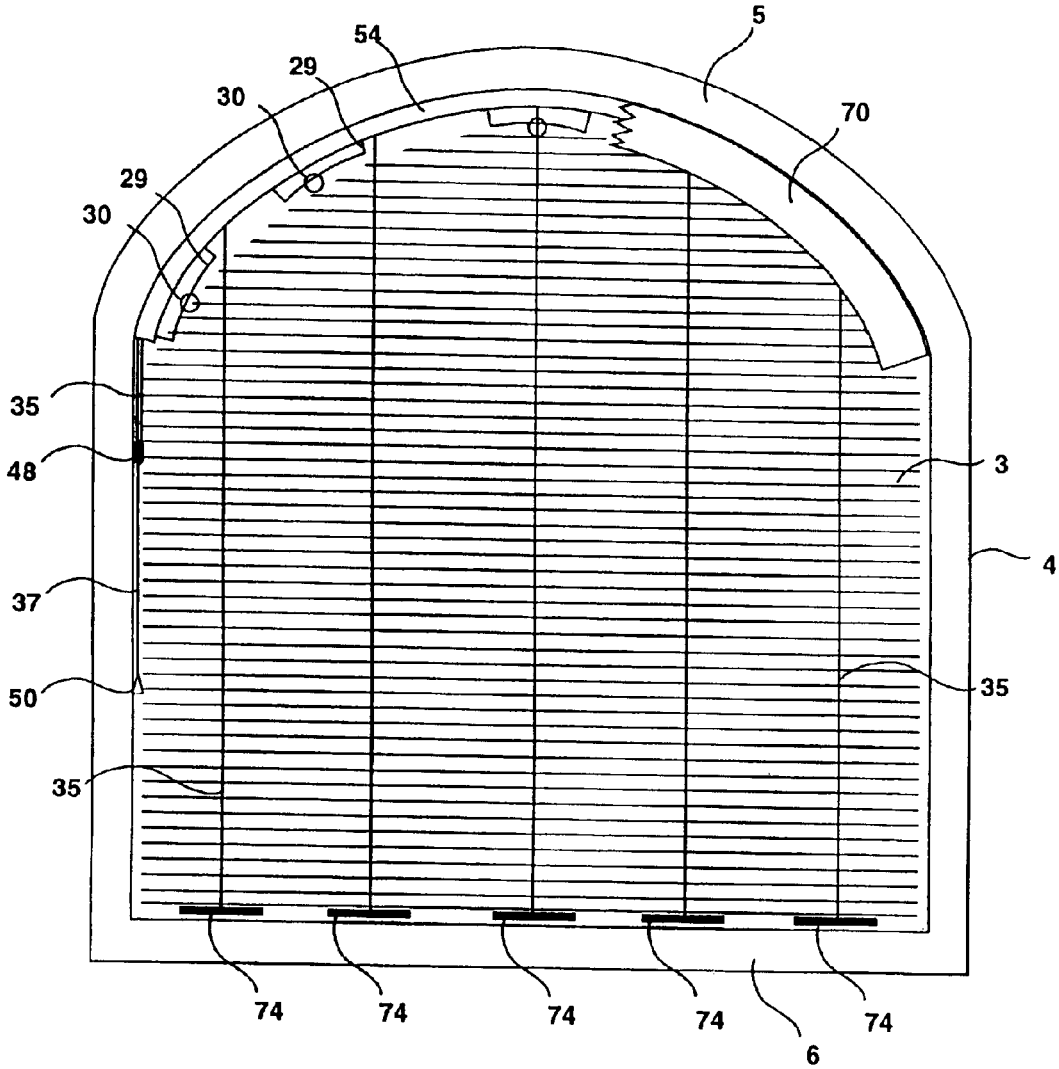
FIG. 27*a* is a front view of an embodiment combining a shade leveling rod with weighted support rods in an arched lintel application with the shade closed.
Figure 27B:
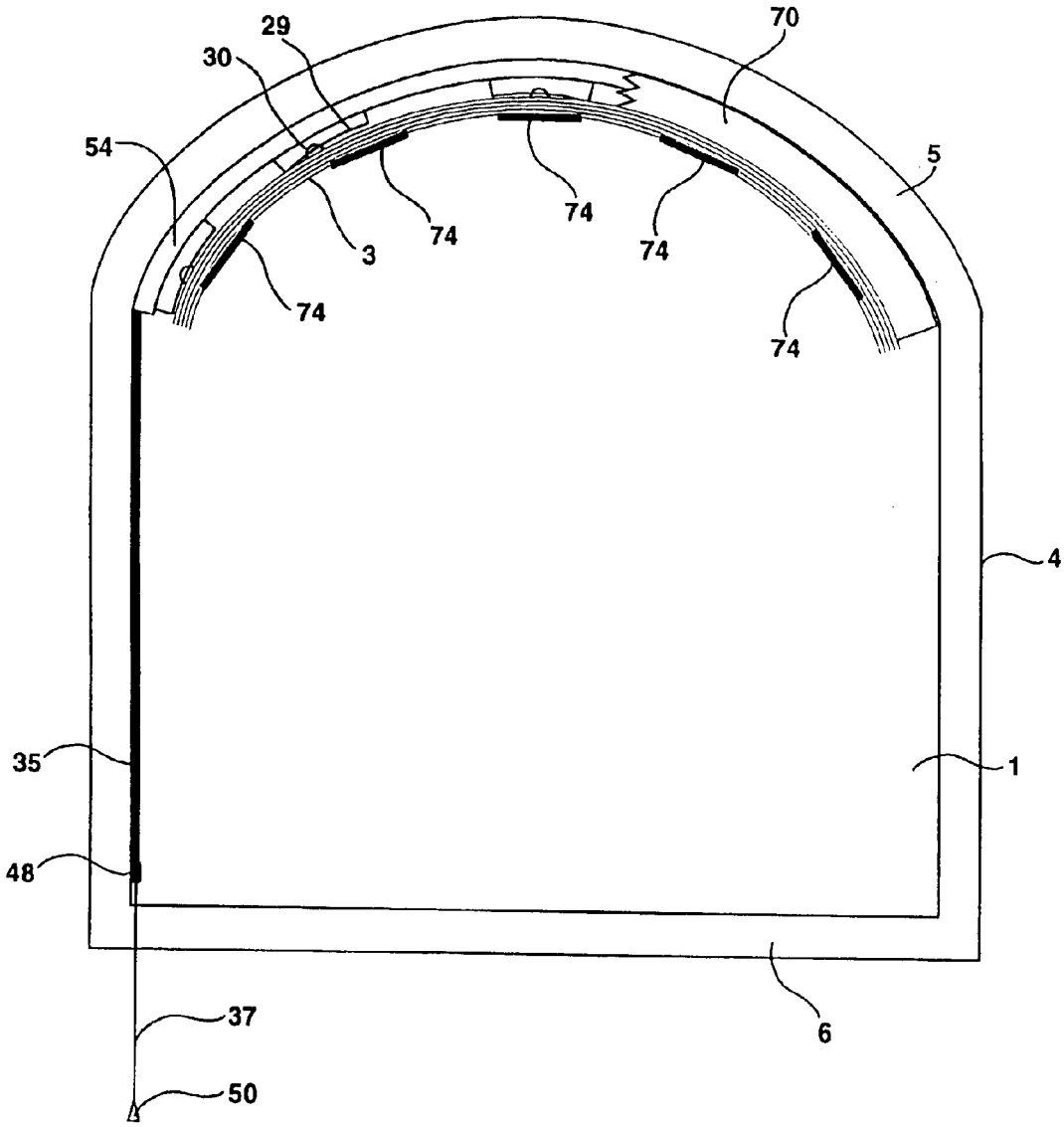
FIG. 27*b* is a front view of an embodiment combining shade leveling rods with weighted support rods in an arched lintel application with the shade open.

In an arched lintel application shown in FIGS. 27*a* and 27*b*, the upper edge of the shade material 3 attached to the shade leveling rods 29 travels freely while the shade material 3 is pulled against and in conformance with the lintel 5. In an arched application, a sectional bottom rail 74 may be used along the bottom edge of the shade material 3. This allows the shade material 3 to be pulled with multiple draw cords 35, as in sections, snugly against the contour of the lintel 5. If the bottom rail 74 is made of a sufficiently flexible material, a single bottom rail 74 with multiple draw cords 35 and attachment points may also suffice.

Figure 22A:
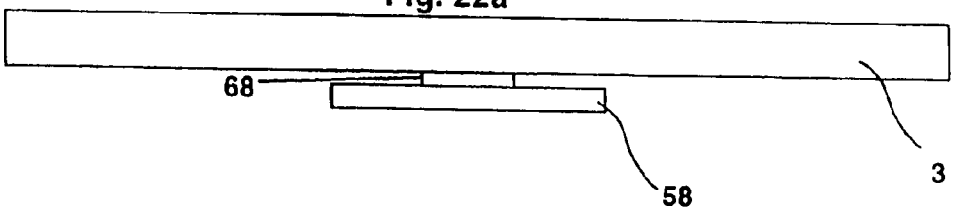
FIG. 22*a* is a top view of a single headrail segment utilizing a shade elevating rod to support shade material.
Figure 22B:
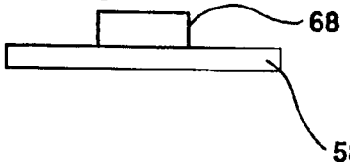
FIG. 22*b* is a top view of a single headrail segment with a shade elevating rod.
Figure 24:
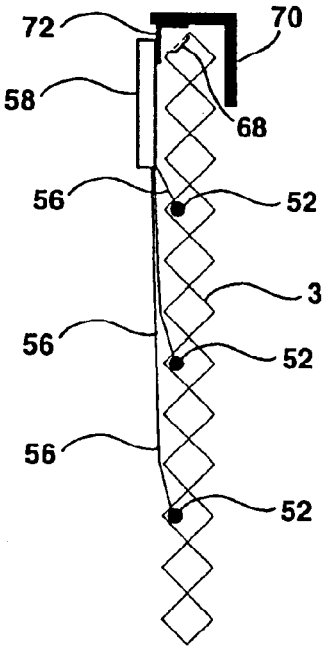
FIG. 24 is a side view of a headrail segment utilizing a shade elevating rod and support rods and which is covered by a valance.

FIGS. 22*a*, 22*b*, and 24 depict a single headrail 58 used in conjunction with a shade elevating rod 68 for supporting shade material. A single headrail 58 may be all that is necessary for use in narrow windows or the angle of pitch or curvature is small. Rather than attaching the single headrail 58 to the shade material 3 with eyelets, the shade elevating rod 68 may be inserted through the top cell of honeycomb shade material 3 or placed within a seam or otherwise attached along the top edge of other shade material 3. The shade elevating rod 68 provides distributed support along a length of the top edge of the shade material 3. The shade elevating rod 68 may additionally be formed in an arc to provide a snug fit against the lintel 5. Similar to a shade leveling rod 29, the shade elevating rod 68 may be composed of wire, metallic rods, or other similar thin-gauge, rigid, tensilely strong material which will not sag.

A decorative valance 70 shown in FIGS. 23 and 24 may be attached to a single headrail 58 via valance brackets 72. The valance 70 and valance brackets 72 may be composed of any suitably dense, rigid material such as wood, plastic, metal, resin, composite, or other similar material. The valance brackets 72 may be attached to the single headrail 58 and the valance 70 via any suitable fastening means such as nails, screws, bolts, rivets, adhesive, or other similar means. The valance 70 may operate to obscure any exposed hardware attachments to the single headrail 58 and additionally provide a tidy cover for the shade material 3 when it rests upon the sill 6.

Figure 25:
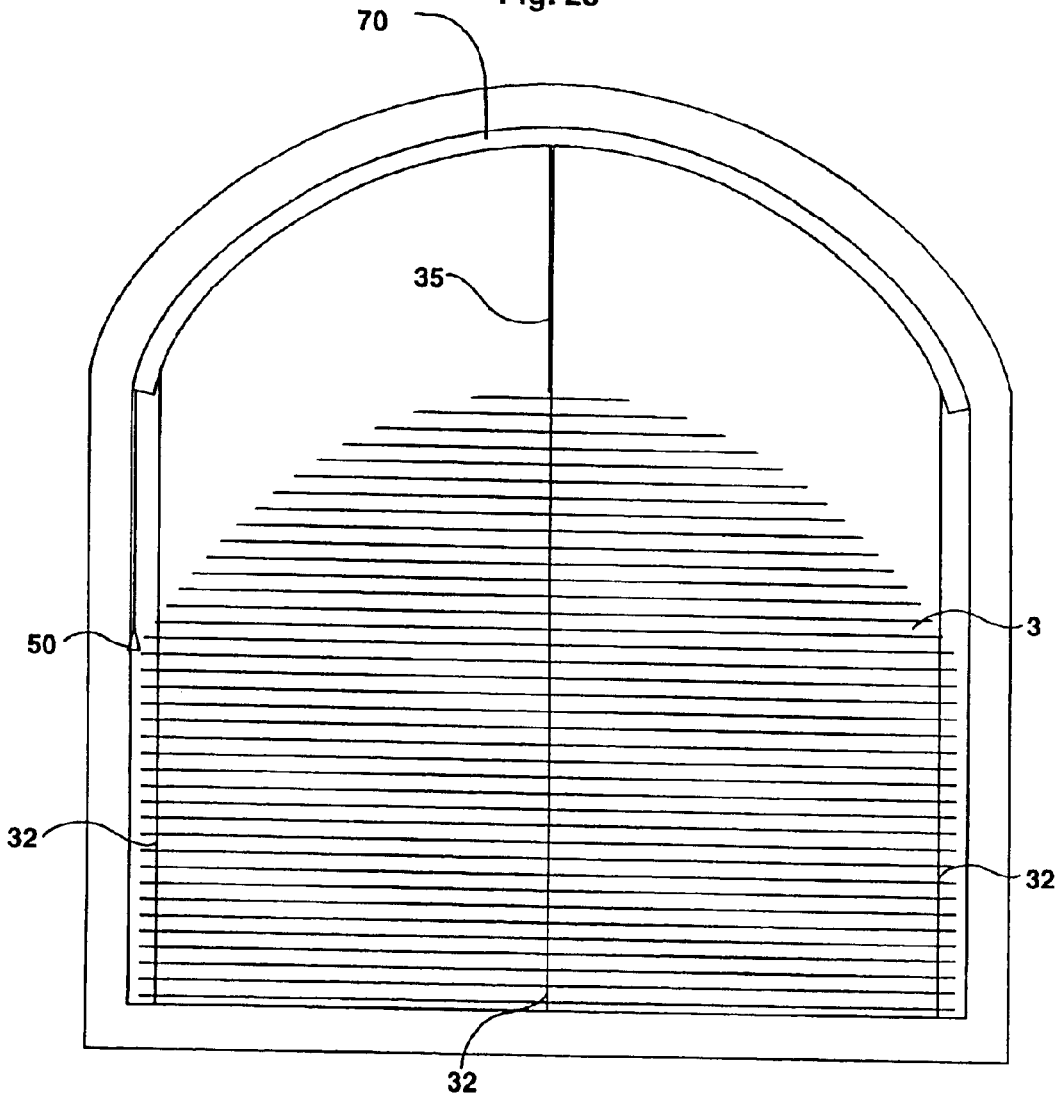
FIG. 25 is a front view of a valance in use in an arched lintel application.

In an arched lintel application, a valance 70 may also be employed as shown in FIG. 25. Here, rather than attaching the valance 70 a sliding headrail 8 or a single headrail 58, the valance 70 is mounted directly to the lintel 5. The valance 70 is a facade used to cover light gaps created by uneven cutting of the shade material 3 or an imperfect window frame 4. The valance 70 may be constructed out of any suitably flexible, resilient material such a plastic, metal, resin, composite, wood or other similar material. The valance 70 may be attached to the lintel 5 by any suitable fastening means such as nails, screws, bolts, rivets, adhesive, or other similar means.

A final aspect to this inventive system is a cord track 54, as shown in FIGS. 16–21*b*, which provides for smooth operation of the draw cord 35. The cord track 54 acts as a guide for the draw cord 35 along the lintel 5, preventing the draw cord 35 from sagging and becoming entangled in the sliding headrail 8 assembly. The cord track 54 also hides the draw cord 35, providing a more aesthetically pleasing lintel 5. The cord track 54 may be mounted on the surface of the lintel 5 or it may be recessed along the length of the lintel 5. The cord track 54 may be composed of any suitably dense material such as wood, metal, plastic, resin, composite, or other similar material. In an arched application the material composing the cord track 54 should also be sufficiently flexible to conform to the curvature of the lintel 5. Preferably, the cord track 54 material should have a low coefficient of friction to prevent unnecessary wear on the draw cord 35 as it moves along and within the cord track 54.

Figure 20A:
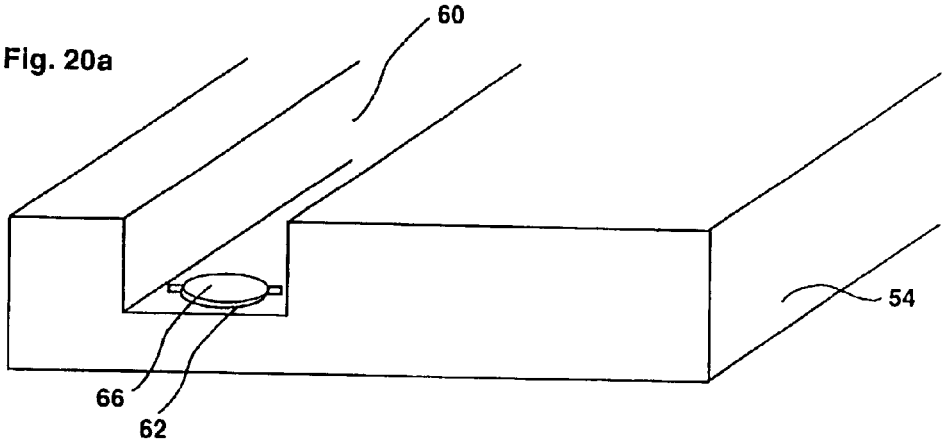
FIG. 20*a* is a partial end perspective view of a cord track with a cord guide.
Figure 20B:
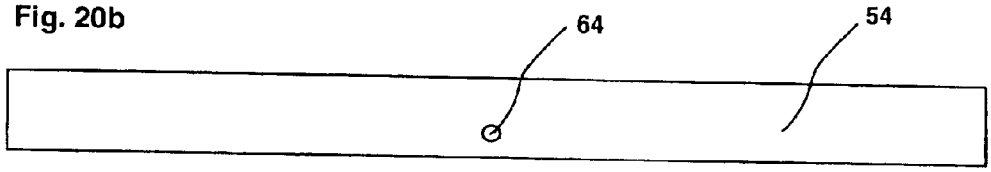
FIG. 20*b* is an exterior view of a cord track for an arched lintel application.
Figure 20C:
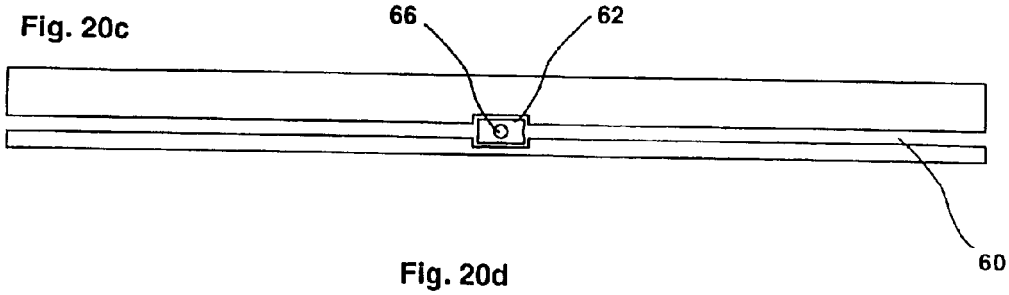
FIG. 20*c* is an interior view of a cord track for an arched lintel application.
Figure 20D:
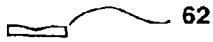
FIG. 20*d* is an end perspective view of a cord guide used in conjunction with a cord track.
Figure 21A:
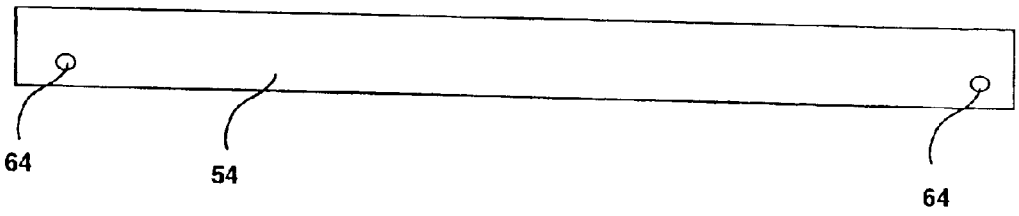
FIG. 21*a* is an exterior view of a cord track for a pitched lintel application.
Figure 21B:
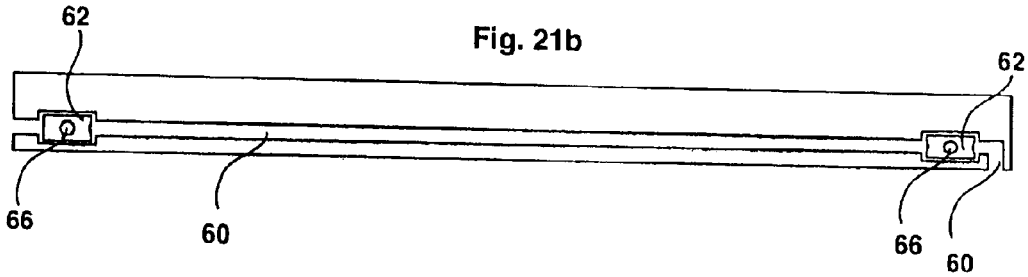
FIG. 21*b* is an interior view of a cord track for a pitched lintel application.
Figure 21C:
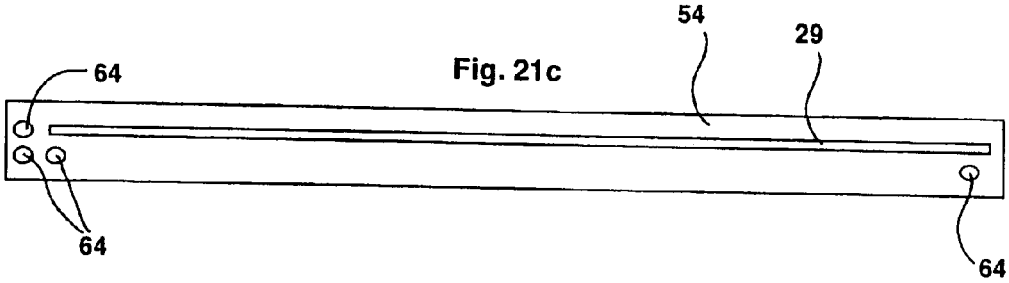
FIG. 21*c* is an exterior view of an alternative embodiment of a cord track for a pitched lintel application.
Figure 21D:
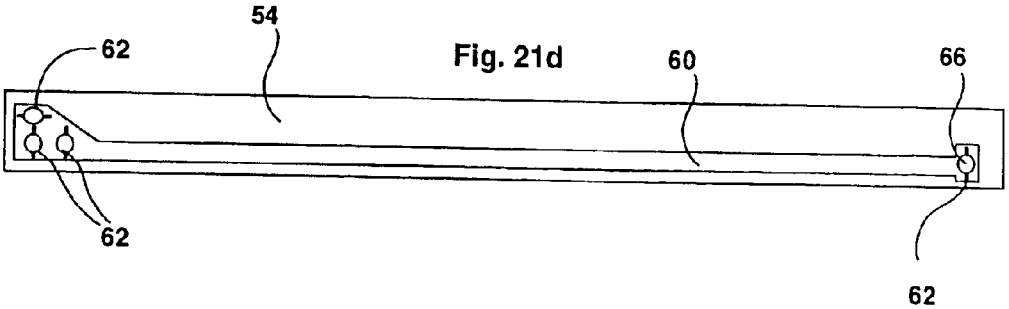
FIG. 21*d* is an interior view of an alternative embodiment of a cord track for a pitched lintel application.

The cord track 54 may consist of several components including a cord path 60 and cord guides 62, FIGS. 20*a*, 20*c* and 20*d*. In an arched lintel 5 application, there is only one draw cord 35 which pulls the sliding headrail 8 from the center of the lintel 5. An aperture in the center of the cord track 54, identified as the cord track hole 64 allows the draw cord to pass into the cord path 60. In a case where the cord track 54 material is not sufficiently friction resistant, a cord guide 62 may be mounted within the cord path 60. The draw cord 35 travels through the cord guide hole 66 and over the cord guide 62 before proceeding along the cord path 60. The cord guide 62 is composed of a material with a very low coefficient of friction which may be beveled around the cord guide hole, or it may be a structure incorporating bearings, to reduce the stress of friction on the draw cord 35 at the fulcrum point. Several possible embodiments of a cord guide are depicted in FIGS. 20*a*, 20*c*, 20*d*, 21*b*, and 21*d*. In an arched application, the cord path 60 may extend from either side of the cord track hole 64 to allow the user to select the side of placement for user access to the draw cord 35. FIGS. 21*a* and 21*b* depict a cord track 54 arrangement for a pitched lintel 5 application. In this embodiment, the cord track 54 includes cord track holes 64 and cord guides 62 on both ends. On the chosen side of user access, the draw cords 35 exits the cord path 60 in the cord track 54 to connect with pull cord 37. The draw cords may exit through a single cord track hole 64 with a cord guide 62, as in FIGS. 21*a* and 21*b*, or through multiple cord track holes 64 with respective cord guides 62, as in FIGS. 21*c* and 21*d*. Multiple outlets for draw cords 35 may be desirable, for example, when a cord stop 29 is used on one draw cord 35; a second cord track hole 64 for the second draw cord 35 allows continued movement of the second draw cord 35 without interference by the cord stop 49 on the first draw cord 35.

Figure 28:
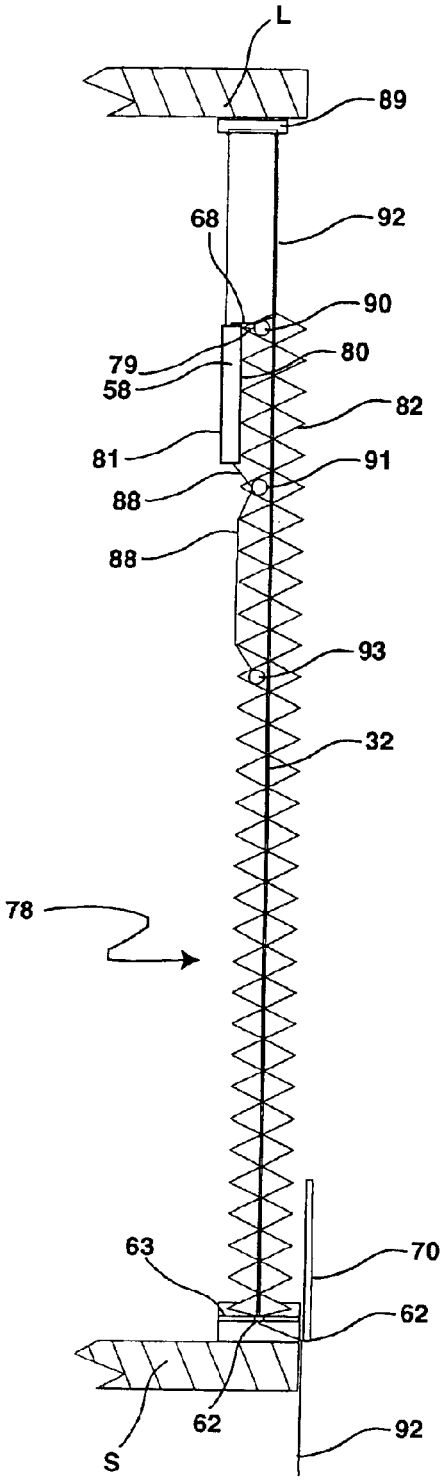
FIG. 28 shows a side view of a bottom up shade in an up position with the snug mechanism attached to the headrail including a top rod, a first and second support rods and a support rod cord.
Figure 35:
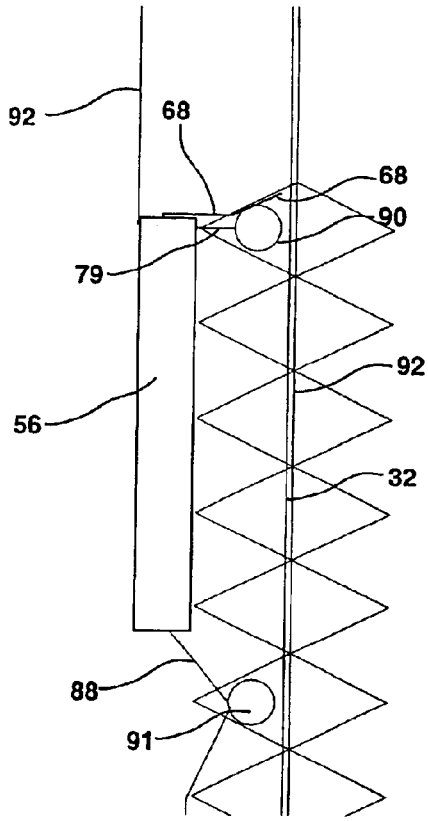
FIG. 35 is a detailed side view of the headrail attachment to the shade material.

FIG. 28 is an illustration of the headrail 58 with the improved mechanism to snug the bottom up shade to the lintel L in an up or closed position. The headrail 58 has an anterior 80 and posterior 81 side. The anterior side 80 mates with the posterior side 81 of the top of the shade material 82. The top of the headrail matches the shape of the lintel L and the top of the shade material 82 or in some embodiments the headrail 85 may be lower than the top of the shade material 82, if there is some impediment to getting the headrail adjacent to the lintel.

In the embodiment as shown in FIG. 28, there are two support rods, a first 91 and a second 93, in the shade material 82 that are attached by the headrail by a top support rod cord 88.

In extended position or when the shade is closed the support rod cord 88 is taut between the headrail and the support rods 91, 93 and, thus, is used to distribute the weight of the shade material.

As illustrated, the first and second support rods 91, 93 are attached to the bottom of the headrail 58. The headrail 58 is attached to the top 95 of the shade material by a top rod 90 inside the top of the material.

The pull cord 92 is attached through a pulley or other device 89 to change the cord direction located at the apex or top of the lintel L. The cord on one end is attached to the headrail at its top 94 in a manner to allow the headrail 58 to come in close proximity to or touching the lintel L. The pulley or redirection device 89 also must accommodate this fit. The easiest method is to have the pulley 89 positioned so that the headrail 58 in the closed position hits the lintel on the posterior side of the pulley. The shade and the top rod 90 would hit on the anterior side of the pulley. The attachment cord 79 between the headrail 58 and top rod 90 in the shade would be a sufficient length to allow the clearance. An alterative would have the shade elevating rod 68 extending up from the headrail to the top rod 90 to push the top of the rod 90 to the lintel when the headrail can not be positioned next to the lintel. Alternately, the redirection device 89 may be inside the lintel. The shade elevating rod 68 is made up of elongated push rod or midsection 69 and support ends 71. The support ends 71 are attached to the top portion of headrail 58 with the push rod or midsection 69 attached to the upper edge of the shade material. The push rod or midsection 69 can be malleable so that it can be bent to conform to the shape of the lintel L.

The other end of the pull cord after going over the pulley would be a centering cord through the shade material and extend to the bottom of the shade. From this position the pull cord would be redirected to the location where the pull cord exits the shade structure and where the user can pull the cord to position the shade either up, down or something in between.

The pull cords path in this embodiment includes cord guides 62 to protect against wear as the cord makes direction changes and to allow for smooth operation of the cord.

Figure 29:
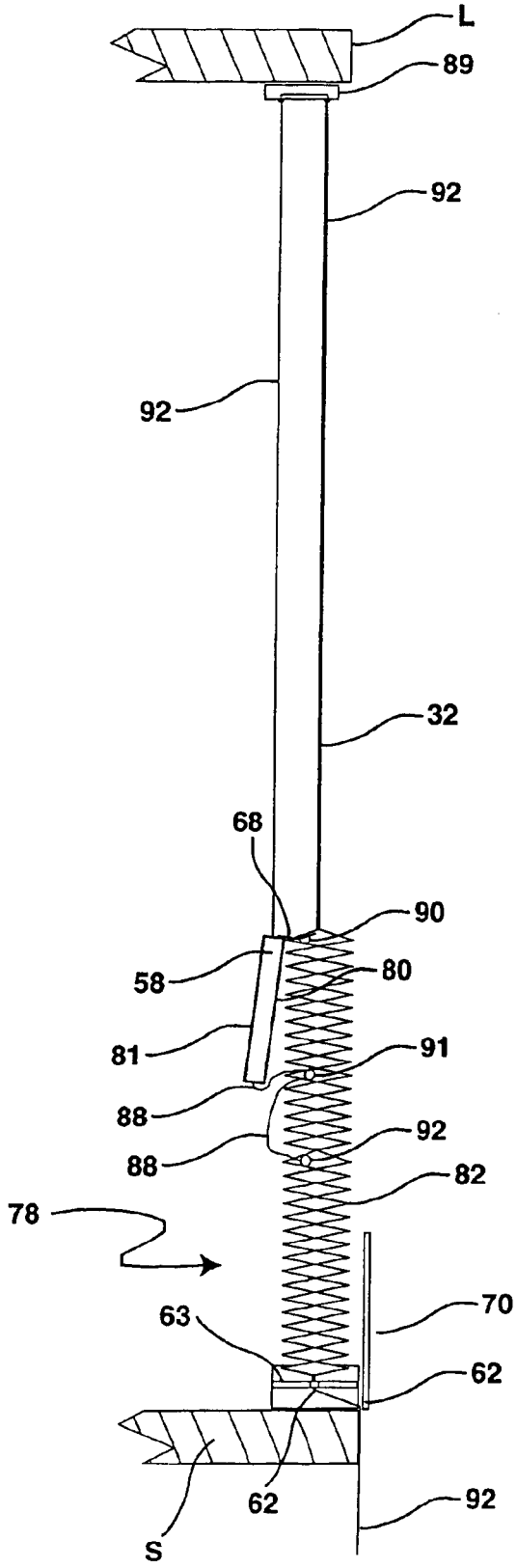
FIG. 29 show the same view as FIG. 28 with the shade in a down position and the support rod cord slack.

In FIG. 29 the shade is in a partially down position with the support rod cord 88 slack. This figure and FIG. 28 illustrates the rotation in the headrail 58 caused by the support rod cord 92 when taut, brings the shade in close relationship to the lintel L. The weight of the shade is distributed by the support rods 91,93. The attachment 94 to the headrail 58 also is the force that snugs the shade up to the lintel and minimizes gaps.

Figure 30:
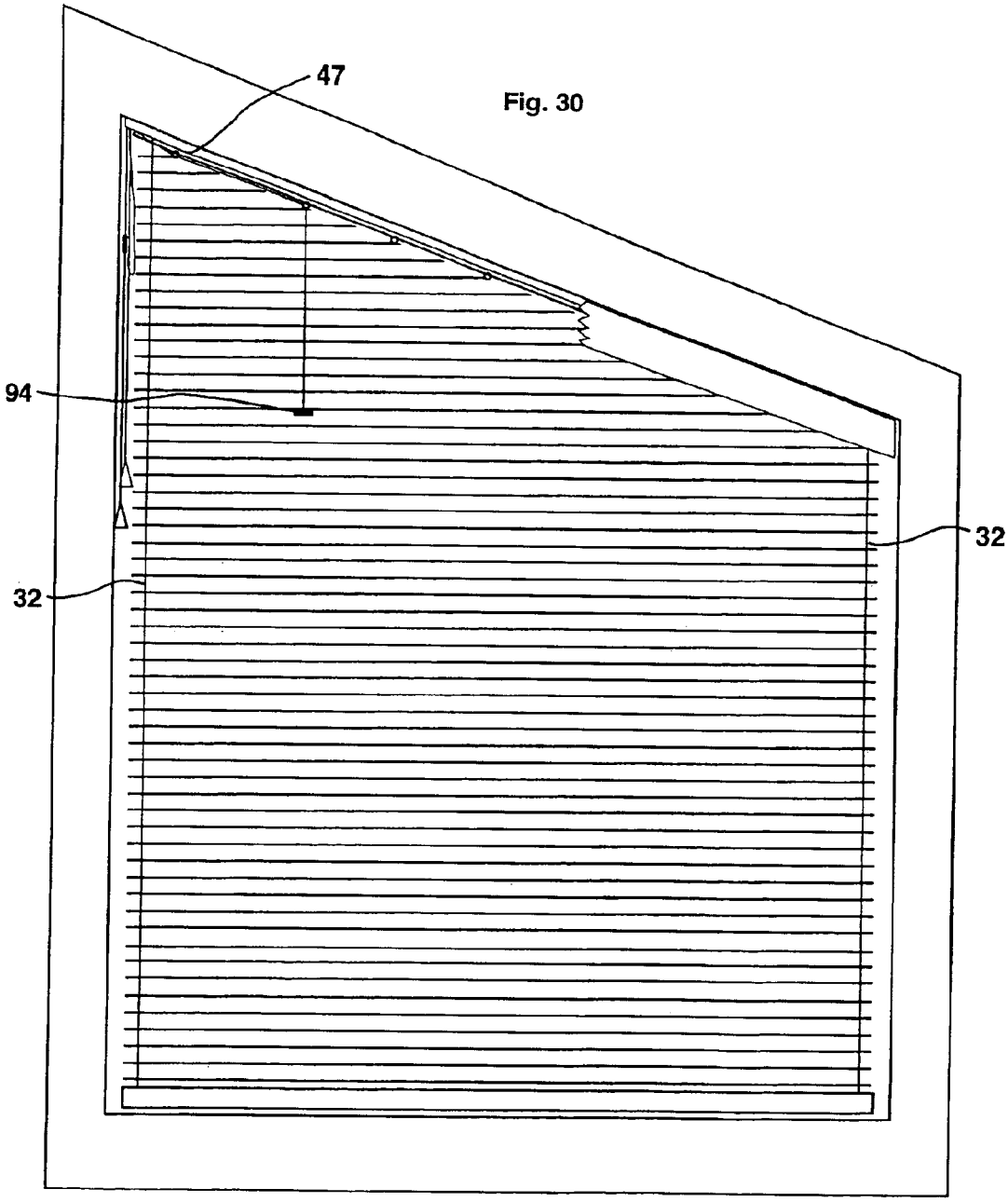
FIG. 30 shows a front view of a trapezoid shade with the centering cord and the side support rod location to obtain a close fit in the long side of the shade.

FIG. 30 illustrates the improvement in angled or trapezoid bottom up shades. The improvement combines the shades centering cord 47 discussed previously, and is illustrated in FIG. 10*d*, with a side support rod 94 on one side of the shade. The effect of the side support rod 94 is to allow the shade to be hung symmetrically at approximately the same level on the long side and the short side. This then minimizes the gaps that can occur on the long side when using the shade centering cord 47. This gap occurs more noticeably when the shade is long or when the angle is very steep, such as with an acute angle as illustrated in FIG. 30.

The mechanism, as an addition to the shade centering cord 47, is to place a side support rod 94 on the long side of the shade attachment in relation to the shade centering cord 47. This then operates to center the headrail against the high side and also to hang the shade material from approximately the same level as the low side and, thus, it hangs straight without a side gap.

Figure 31:
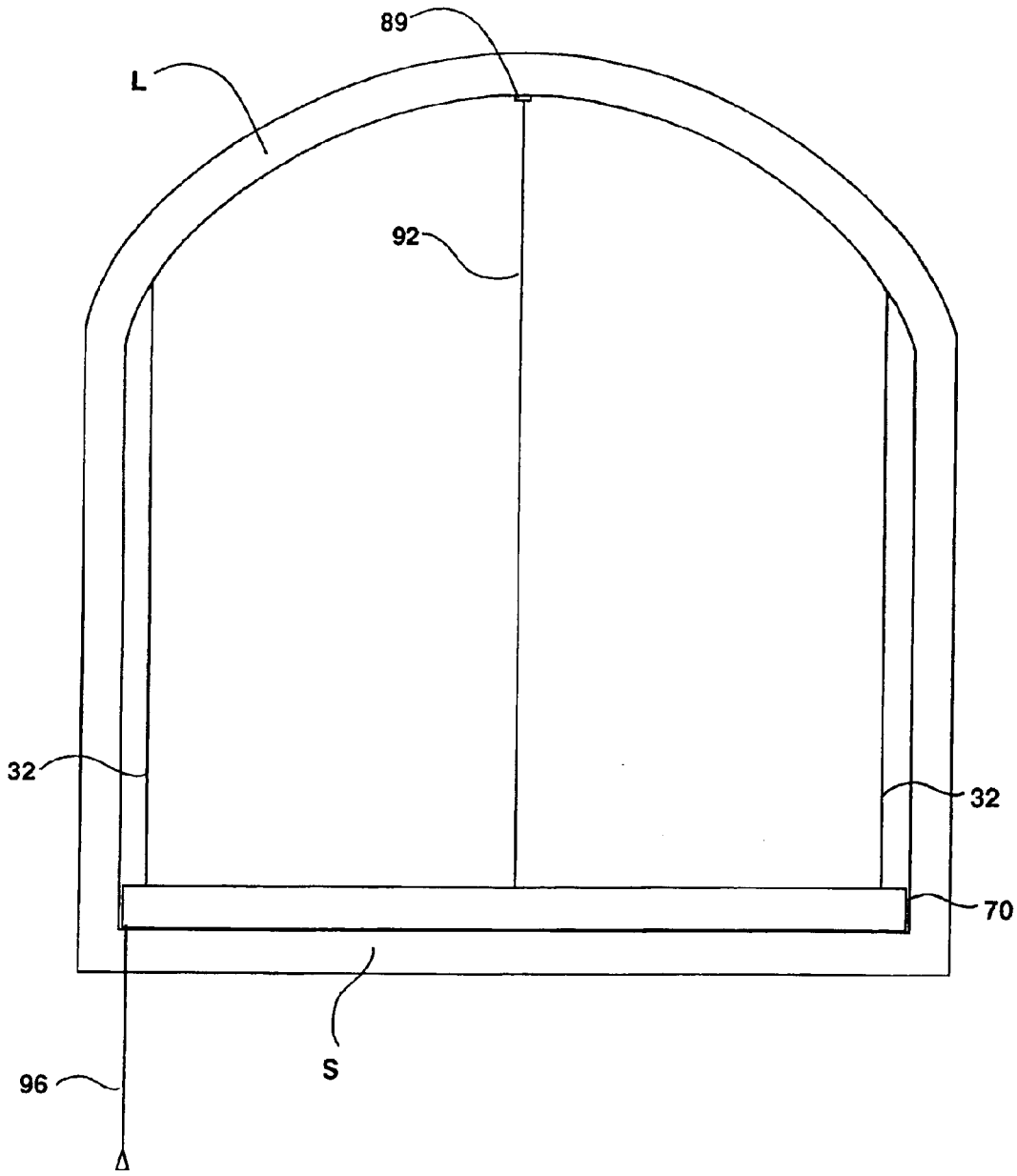
FIG. 31 shows a front view of the shade in FIG. 28 with the shade in a down position and held and hidden by a valance.
Figure 32:
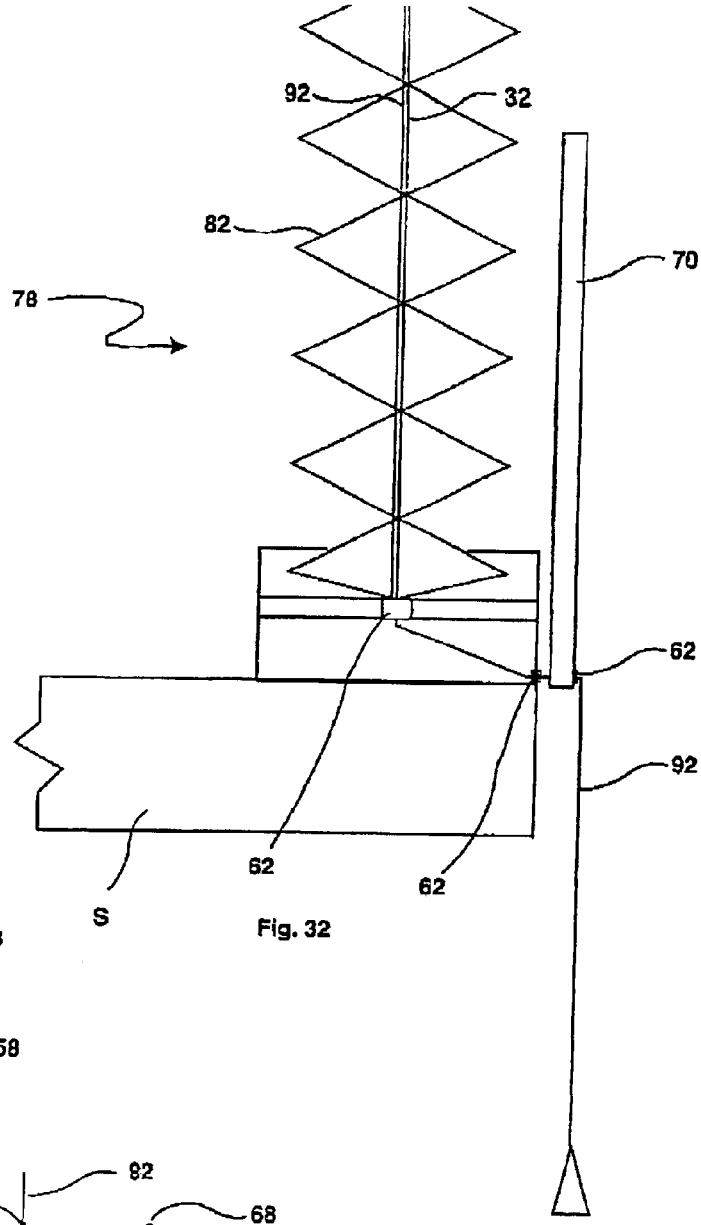
FIG. 32 illustrates a side view of the valance and the guides for the pull cord.
Figure 33:
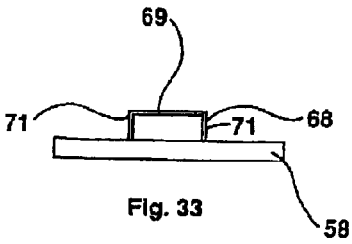
FIG. 33 is a top view of the headrail showing the elevating rod.
Figure 34:
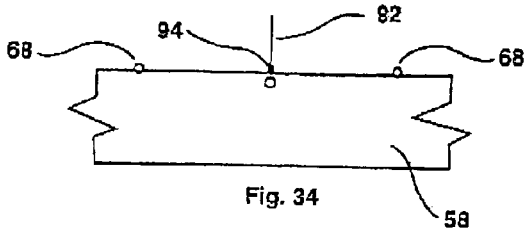
FIG. 34 is a side view of the headrail showing the pull cord attachment.
Figure 36:
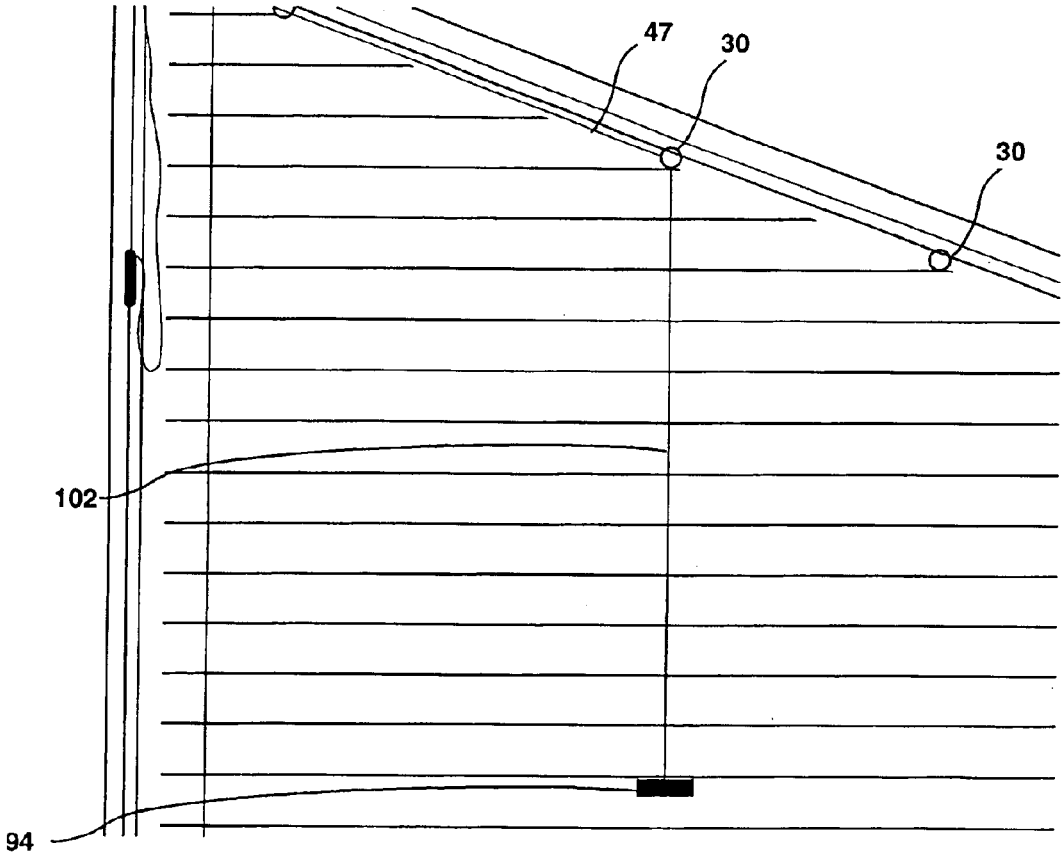
FIG. 36 is an expanded front view of the shade in FIG. 30.

FIG. 31 illustrates the use of the valance 70 on a bottom up shade. The valance as a part of the shade apparatus operates to hold the shade material when it is in the down position. It also is to be part of the structure housing the bottom draw cord 96 with the directional hardware included so that the cord works properly without the hardware being visible. The valance also acts to hide the shade and headrail component when they are down. Finally by incorporating the valance with the shade's mechanism the installation is made easier as the components are operationally mounted at the factory. The final field installation can then be only the pull cord redirection device 89 mounting at the top and any guide lines to be used. The incorporation of the valance allows the mechanism to work with a valance. Some bottom up shade mechanisms do not allow for the use of a valance when the shade is in the down position.

What is claimed is:

1. A window shade apparatus to cover a window having a lintel and a sill, the apparatus comprising:

a) shade material, a portion of the perimeter of which is defined as a top edge and a portion of the perimeter of which is defined as a bottom edge;

b) a headrail, the headrail is positioned adjacent to the top edge of the shade material;

c) a shade elevating rod comprising a first part fixedly attached to the headrail and a second part fixedly attached to the top edge of the shade material, the second part of the shade elevating rod extending distally from the headrail;

d) at least one shade support rod attached to the shade material;

e) a support rod cord attaching the headrail to the support rod; and f) means for raising and lowering the headrail and thereby the shade material to a cover and an uncover position of the window, the raising and lowering means is attached to the headrail.

2. The window shade apparatus of claim 1 wherein the headrail is positioned slightly below the top edge of the shade material.

3. The window shade apparatus of claim 1 wherein the top edge of the headrail is formed to conform to the shape of the lintel.

4. The window shade apparatus of claim 1 wherein the second part of the shade elevating rod is formed to conform to the shape of the lintel.

5. The window shade apparatus of claim 1 wherein the shade elevating rod comprises a malleable rod with two ends and a midsection, the first part of the shade elevating rod defined by the ends of the rod, and the second part of the support member defined by the midsection.

6. The window shade apparatus of claim 5 wherein the midsection of the rod is formed to conform to the shape of the lintel.

7. The window shade apparatus of claim 1 wherein the means for raising and lowering comprises one or more cords attached to the headrail, each cord being:

a) moveably supported at a respective fulcrum point, each fulcrum point centered over respective attachment points of the cords to the headrail;

b) routed through a channel for easy access by a user; and c) engagingly attached to engagement means.

8. The window shade apparatus of claim 7 further comprising a second channel mounted to the sill, the second channel enclosing and directing the cords along the bottom edge of the shade material.

9. The window shade apparatus of claim 8 wherein the second channel is within the bottom edge of the shade material.

10. The window shade of claim 1 wherein the bottom edge of the shade material is covered by a valance.

11. A window shade apparatus for covering a window having a lintel and sill, the shade comprising:

a) a headrail;

b) a shade material sized to cover the window and having a top edge and a bottom edge and opposing side edges;

c) a means for attaching the headrail adjacent to the top edge of the shade material;

d) a means to raise and lower the headrail with respect to the window;

e) a means to support the shade material vertically so as to center it in the window opening;

f) said support means includes a side support rod located between the top and bottom edge of the shade material and closer to one side edge of the shade material than the opposite side edge, and a centering cord attached to the side support rod and arranged to be taut when the headrail is raised to the cover position.

12. The shade apparatus of claim 11 wherein the lintel of the window is sloped which forms a long side edge on said shade material corresponding to a high end of said lintel.

13. The shade apparatus of claim 12 wherein the side support rod is nearer to the long side edge of the shade.

14. The shade apparatus of claim 13 wherein the side support rod is attached to the shade material at a location which is approximately at the same elevation of a low end of the lintel when the shade is fully raised.

15. The window shade apparatus of claim 1 wherein the shade support rods are attached to the shade material, such support rod being spacedly positioned with respect to each other, and each rod is connected by a cord to the headrail, the length of the cord is arranged so that the cord is pulled taut when the headrail and shade material is raised to the cover position.

16. The window shade apparatus of claim 1 which further includes means for attaching the bottom edge of the shade material to a window sill.

* * * * *